US009534279B2

(12) United States Patent
Masuda et al.

(10) Patent No.: US 9,534,279 B2
(45) Date of Patent: Jan. 3, 2017

(54) HIGH-STRENGTH COLD-ROLLED STEEL SHEET HAVING SMALL VARIATIONS IN STRENGTH AND DUCTILITY AND MANUFACTURING METHOD FOR THE SAME

(71) Applicant: Kabushiki Kaisha Kobe Seiko Sho (Kobe Steel, Ltd.), Kobe-shi (JP)

(72) Inventors: Tomokazu Masuda, Kobe (JP); Hideo Hata, Kobe (JP); Katsura Kajihara, Kobe (JP); Toshio Murakami, Kobe (JP); Masaaki Miura, Kakogawa (JP); Muneaki Ikeda, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 422 days.

(21) Appl. No.: 14/362,782

(22) PCT Filed: Dec. 11, 2012

(86) PCT No.: PCT/JP2012/082058

§ 371 (c)(1),
(2) Date: Jun. 4, 2014

(87) PCT Pub. No.: WO2013/089095

PCT Pub. Date: Jun. 20, 2013

(65) Prior Publication Data

US 2014/0305553 A1 Oct. 16, 2014

(30) Foreign Application Priority Data

Dec. 15, 2011 (JP) ..... 2011-274268
Dec. 15, 2011 (JP) ..... 2011-274269

(51) Int. Cl.
*C22C 38/38* (2006.01)
*C21D 8/02* (2006.01)
(Continued)

(52) U.S. Cl.
CPC ..... *C22C 38/38* (2013.01); *C21D 1/20* (2013.01); *C21D 1/25* (2013.01); *C21D 8/0263* (2013.01);
(Continued)

(58) Field of Classification Search
CPC ..... C21D 1/26; C21D 1/28; C21D 1/30; C21D 1/32; C21D 9/46; C21D 2211/002; C21D 2211/003; C21D 2211/004; C21D 2211/005; C21D 2211/008
See application file for complete search history.

(56) References Cited

U.S. PATENT DOCUMENTS 8,343,288 B2 1/2013 Murakami et al.
8,679,265 B2 3/2014 Murakami et al.
(Continued)

FOREIGN PATENT DOCUMENTS

JP 2000-212684 8/2000
JP 2003-277832 10/2003
(Continued)

OTHER PUBLICATIONS

International Search Report and Written Opinion of the International Searching Authority issued Mar. 5, 2013, in PCT/JP2012/082058, filed Dec. 11, 2012.

*Primary Examiner* — Roy King
*Assistant Examiner* — Vanessa Luk
(74) *Attorney, Agent, or Firm* — Oblon, McClelland, Maier & Neustadt, L.L.P.

(57) ABSTRACT

A high-strength cold-rolled steel sheet has a chemical composition including C of 0.05% to 0.30%, Si of greater than 0% to 3.0%, Mn of 0.1% to 5.0%, P of greater than 0% to 0.1%, S of greater than 0% to 0.02%, Al of 0.01% to 1.0%, and N of greater than 0% to 0.01%, in mass percent, with the remainder including iron and inevitable impurities. The steel
(Continued)

(a) STEEL SHEET OF INVENTION (STEEL SHEET No. 38)

(b) COMPARATIVE STEEL SHEET (STEEL SHEET No. 43)

sheet has a microstructure containing ferrite as a soft primary phase in an area percentage of 20% to 50% with the remainder including tempered martensite and/or tempered bainite as a hard secondary phase. The ferrite grains are adapted to contain cementite particles having an appropriate size in an appropriate number density.

12 Claims, 2 Drawing Sheets

(51) Int. Cl.

| | |
|---|---|
| ***C21D 9/46*** | (2006.01) |
| ***C22C 38/00*** | (2006.01) |
| ***C22C 38/06*** | (2006.01) |
| ***C22C 38/02*** | (2006.01) |
| ***C22C 38/04*** | (2006.01) |
| ***C21D 8/04*** | (2006.01) |
| ***C21D 1/20*** | (2006.01) |
| ***C21D 1/25*** | (2006.01) |
| ***C22C 38/08*** | (2006.01) |
| ***C22C 38/12*** | (2006.01) |
| ***C22C 38/16*** | (2006.01) |

(52) U.S. Cl.

CPC ..... *C21D 8/0436* (2013.01); *C21D 8/0447* (2013.01); *C21D 8/0473* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C21D 9/46* (2013.01); *C21D 2211/002* (2013.01); *C21D 2211/004* (2013.01); *C21D 2211/005* (2013.01); *C21D 2211/008* (2013.01)

(56) References Cited

U.S. PATENT DOCUMENTS

| | | | | |
|---|---|---|---|---|
| 2004/0238082 | A1* | 12/2004 | Hasegawa | C22C 38/02 148/652 |
| 2009/0277547 | A1 | 11/2009 | Saito et al. | |
| 2010/0252147 | A1 | 10/2010 | Murakami et al. | |
| 2011/0024004 | A1 | 2/2011 | Azuma et al. | |
| 2012/0012231 | A1 | 1/2012 | Murakami et al. | |

FOREIGN PATENT DOCUMENTS

| | | | |
|---|---|---|---|
| JP | 2007-138262 | | 6/2007 |
| JP | 2007-302918 | | 11/2007 |
| JP | 2011-80106 | | 4/2011 |
| KR | 10-2010-0070375 | A | 6/2010 |
| KR | 10-2010-0113643 | A | 10/2010 |
| WO | 2009/066734 | A1 | 5/2009 |
| WO | 2009/125874 | A1 | 10/2009 |

* cited by examiner (a) STEEL SHEET OF INVENTION (STEEL SHEET No. 38)

(b) COMPARATIVE STEEL SHEET (STEEL SHEET No. 43)

HIGH-STRENGTH COLD-ROLLED STEEL SHEET HAVING SMALL VARIATIONS IN STRENGTH AND DUCTILITY AND MANUFACTURING METHOD FOR THE SAME

TECHNICAL FIELD

The present invention relates to a high-strength steel sheet and a manufacturing method thereof, where the high-strength steel sheet has excellent workability and is usable typically in automobile parts.

BACKGROUND ART

High-strength steel sheets having a tensile strength of 590 MPa or more have recently been applied as structural parts for automobiles in wider and wider applications with growing needs to provide both better fuel efficiency and satisfactory crashworthiness of automobiles. The high-strength steel sheets, however, have larger variations in mechanical properties such as yield strength, tensile strength, and work hardening coefficient than those of mild steels and thereby have disadvantages as follows. When the steel sheets are subjected to press forming, the variations cause a variation in springback and cause the resulting press-formed articles to fail to have satisfactory dimensional accuracy surely. In addition, the steel sheets should be designed to have a somewhat higher average strength so as to ensure required strengths of the press-formed articles even when they have a variation in strength. This leads to a shorter life of a press forming tool.

To solve the disadvantages, various efforts have been made to reduce variations in mechanical properties of high-strength steel sheets. The variations in mechanical properties of the high-strength steel sheets may be attributed to fluctuations in chemical composition and in manufacturing conditions. Based on this, proposals as follows have been made to reduce variations in mechanical properties.

Conventional Technology 1

Typically, Patent Literature (PTL) 1 discloses a technique of reducing variations in mechanical properties. The technique relates to a steel sheet and a manufacturing method thereof. The steel sheet has a dual phase structure of ferrite and martensite, where A as specified by expression: $A=Si+9\times Al$ meets a condition expressed as: $6.0\leq A\leq 20.0$. The manufacturing method of the steel sheet performs a recrystallization annealing-tempering treatment by holding the work at a temperature of Ac1 to Ac3 for 10 seconds or longer, slowly cooling the work from 500° C. down to 750° C. at a cooling rate of 20° C./s or less; thereafter rapidly cooling the work down to 100° C. or lower at a cooling rate of 100° C./s or more; and tempering the work at a temperature of 300° C. to 500° C. This allows the steel sheet to have a higher A3 point and thereby allows the dual phase structure to have better stability even when the rapid cooling start temperature, i.e., the slow cooling end-point temperature fluctuates.

Conventional Technology 2

PTL 2 discloses a technique for reducing variations in strength of a steel sheet. According to the technique, the variation reduction is performed by previously determining how the tensile strength of a steel sheet varies depending on the thickness, carbon content, phosphorus content, quench start temperature, quench stop temperature, and post-quenching tempering temperature; calculating the quench start temperature according to a target tensile strength in consideration of the thickness, carbon content, phosphorus content, quench stop temperature and post-quenching tempering temperature of the steel sheet to be manufactured; and starting quenching at the determined quench start temperature.

Conventional Technology 3

PTL 3 discloses a technique for improving (reducing) variations in elongation properties in a transverse direction of a steel sheet. The technique relates to a steel sheet having a microstructure including 3% or more of retained austenite, and a manufacturing method thereof. According to the technique, the variation reduction is achieved by an annealing treatment after cold rolling of a hot-rolled steel sheet. The annealing treatment is performed by soaking the work at a temperature of higher than 800° C. to lower than Ac3 point for a time of 30 seconds to 5 minutes; primarily cooling the work down to a temperature range of 450° C. to 550° C.; subsequently secondarily cooling the work down to a temperature of 450° C. to 400° C. at a cooling rate lower than the primary cooling rate; and further holding the work in a temperature range of 450° C. to 400° C. for one minute or longer.

The conventional technology 1 reduces microstructure fraction variations due to annealing temperature fluctuations by increasing the Al content to elevate the Ac3 point, whereby widening the dual-phase temperature range of Ac1 to Ac3, and reducing the temperature dependency of the steel in the dual-phase temperature range. In contrast, the present invention reduces variations in mechanical properties due to microstructure fraction variations by allowing fine cementite particles to disperse in a considerable number in ferrite grains to invite precipitation hardening and to increase ferrite hardness and by decreasing the carbon content in a hard secondary phase to reduce the hardness of the secondary phase, and thereby reducing the difference in hardness between the respective microstructures. The conventional technology 1 therefore fails to indicate the technical idea of the present invention. In addition, the conventional technology 1 has to increase the Al content and disadvantageously suffers from increased production cost of the steel sheet.

The conventional technology 2 changes the quench temperature according to the change in chemical composition and fails to reduce variations in elongation and stretch flangeability due to coil-to-coil fluctuations in microstructure fractions, although it can reduce variations in strength.

The conventional technology 3 fails to indicate variation reduction in stretch flangeability, although it refers to variation reduction in elongation.

CITATION LIST

Patent Literature

PTL 1: Japanese Unexamined Patent Application Publication (JP-A) No. 2007-138262

PTL 2: JP-A No. 2003-277832

PTL 3: JP-A No. 2000-212684

SUMMARY OF INVENTION

Technical Problem

Accordingly, an object of the present invention is to provide a high-strength cold-rolled steel sheet that less suffers from variations in mechanical properties (particularly strength and ductility) without being affected by fluctuations in annealing conditions and without causing increase in production cost due to regulation of the chemical composition. Another object of the present invention is to provide a manufacturing method of the cold-rolled steel sheet.

Solution to Problem

The present invention provides a high-strength cold-rolled steel sheet having small variations in strength and ductility. The cold-rolled steel sheet includes:

C in a content of 0.05% to 0.30%;

Si in a content of greater than 0% to 3.0%;

Mn in a content of 0.1% to 5.0%;

P in a content of greater than 0% to 0.1%;

S in a content of greater than 0% to 0.02%;

Al in a content of 0.01% to 1.0%; and

N in a content of greater than 0% to 0.01%, in mass percent in a chemical composition, in which:

the cold-rolled steel sheet further includes iron and inevitable impurities in the chemical composition;

the cold-rolled steel sheet includes ferrite as a soft primary phase in an area percentage of 20% to 50% in a microstructure;

the cold-rolled steel sheet further comprises at least one of tempered martensite and tempered bainite as a hard secondary phase in the microstructure; and the cold-rolled steel sheet meets one of conditions (a) and (b) as follows:

(a) cementite particles having an equivalent circle diameter of 0.05 μm to less than 0.3 μm are dispersed in grains of the ferrite in a number density of greater than 0.15 to 0.50 per square micrometer of the ferrite; and (b) cementite particles having an equivalent circle diameter of 0.3 μm or more are dispersed in grains of the ferrite in a number density of 0.05 to 0.15 per square micrometer of the ferrite (claim 1).

The high-strength cold-rolled steel sheet having small variations in strength and ductility may further include:

Cr in a content of 0.01% to 1.0% in the chemical composition (claim 2).

The high-strength cold-rolled steel sheet having small variations in strength and ductility may further include at least one element selected from the group consisting of.

Mo in a content of 0.01% to 1.0%;

Cu in a content of 0.05% to 1.0%; and

Ni in a content of 0.05% to 1.0%, in the chemical composition (claim 3).

The high-strength cold-rolled steel sheet having small variations in strength and ductility may further include at least one element selected from the group consisting of:

Ca in a content of 0.0001% to 0.01%;

Mg in a content of 0.0001% to 0.01%;

Li in a content of 0.0001% to 0.01%; and a rare-earth element (REM) or REMs in a content of 0.0001% to 0.01%, in the chemical composition (claim 4).

In addition and advantageously, the present invention provides a method for manufacturing a high-strength cold-rolled steel sheet having small variations in strength and ductility. The method includes the steps of:

preparing a steel having the chemical composition as defined above;

hot-rolling and subsequently cold-rolling the steel under conditions (1) and (2), respectively, to give a steel sheet as a work;

annealing the work under a condition (3) or (3') after the cold rolling, and tempering the work under condition (4) after the annealing, the conditions (1), (2), (3), (3'), and (4) are as follows:

(1) hot rolling condition:

finish rolling end temperature: $Ar_3$ point or higher coiling temperature: 450° C. to 600° C.

(2) cold rolling condition:

cold rolling reduction: 20% to 50%

(3) annealing condition:

heating the work from mom temperature up to 600° C. at a first heating rate of greater than 5.0° C./s to 10.0° C./s and further heating the work from 600° C. up to an annealing temperature at a second heating rate of half the first heating rate or less; holding the work at the annealing temperature of Ac1 to lower than (Ac1+Ac3)/2 for an annealing holding time of 3600 seconds or shorter, slowly cooling the work from the annealing temperature down to a first cooling end temperature of 730° C. to 500° C. at a first cooling rate of 1° C./s to less than 50° C./s; and thereafter rapidly cooling the work down to a second cooling end temperature of Ms point or lower at a second cooling rate of 50° C./s or more;

(3') annealing condition:

heating the work from mom temperature up to 600° C. at a first heating rate of 0.5° C./s to 5.0° C./s and further heating the work from 600° C. up to an annealing temperature at a second heating rate half the first heating rate or less; holding the work at the annealing temperature of (Ac1+Ac3)/2 to Ac3 for an annealing holding time of 3600 seconds or shorter, slowly cooling the work from the annealing temperature down to a first cooling end temperature of 730° C. to 500° C. at a first cooling rate of 1° C./s to less than 50° C./s; and thereafter rapidly cooling the work down to a second cooling end temperature of Ms point or lower at a second cooling rate of 50° C./s or more.

(4) tempering condition:

tempering temperature: 300° C. to 500° C.

tempering holding time: in a temperature range of 300° C. to the tempering temperature for 60 to 1200 seconds (claim 5).

Advantageous Effects of Invention

The present invention can provide a high-strength steel sheet having smaller variations in strength and ductility. The high-strength steel sheet includes a dual phase steel including ferrite as a soft primary phase and tempered martensite and/or tempered bainite as a hard secondary phase. The high-strength steel sheet is obtained by actively dispersing cementite particles of an appropriate size in ferrite grains to invite precipitation hardening to thereby increase the hardness of ferrite; and by reducing the carbon content in the hard secondary phase and thereby reducing the difference in hardness between the respective microstructures. Thus, variations in mechanical properties due to microstructure fraction fluctuations are reduced.

DESCRIPTION OF EMBODIMENTS

Figure 1:
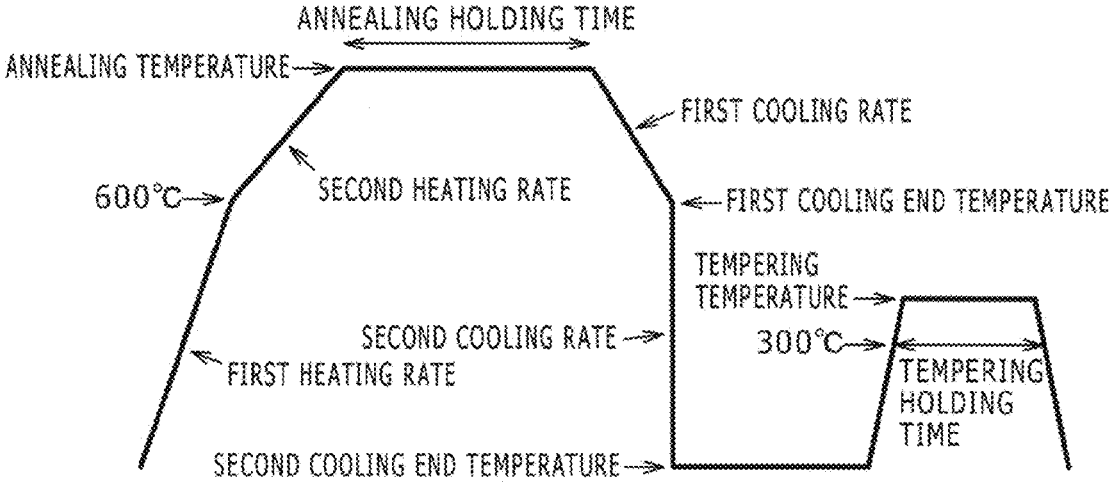
FIG. 1 schematically illustrates a heat treatment pattern in First and Second Experimental Examples.

To achieve the objects, the present inventors focused attention on a high-strength steel sheet having a dual phase microstructure including ferrite as a soft primary phase and tempered martensite and/or tempered bainite as a hard secondary phase. They investigated on ways to reduce variations in mechanical properties of the high-strength steel sheet. The tempered martensite and/or tempered bainite is hereinafter also generically referred to as "tempered martensite or the like". The mechanical properties are hereinafter also simply referred to as "properties".

The variations in properties are caused as follows. When manufacturing conditions fluctuate, fractions of ferrite and the hard secondary phase fluctuate, and this causes a variation in hardness of the hard secondary phase and thereby causes the variations in the properties.

Based on this, the present inventors considered that variations in the properties can be suppressed by reducing the difference in hardness between ferrite and the hard secondary phase even when the microstructure fractions fluctuate. The present inventors also considered that the difference in hardness between ferrite and the hard secondary phase may be effectively reduced by performing precipitation hardening of ferrite and by allowing carbon to distribute more in ferrite and thereby reducing the strength of tempered martensite or the like. While thinking that appropriate adaptation of heat treatment conditions, particularly annealing conditions, after cold rolling is necessary for the above-mentioned configuration, the present inventors have come to realize that the configuration can be achieved by employing two different annealing conditions. The annealing conditions (first and second annealing conditions) will specifically be described later.

The first annealing condition in annealing of a cold-rolled steel is as follows. Initially, the step of heating is performed so that ferrite is recrystallized, and cementite is allowed to remain in ferrite. Control of the heating rate within a predetermined range allows ferrite to take the residual cementite therein to form a microstructure including fine cementite particles present in a considerable number in ferrite grains.

Next, soaking from the Ac1 point (transformation start temperature) to an annealing temperature (in the dual-phase temperature range) is performed so as not to excessively dissolve the cementite particles. To this end, the annealing temperature is set to a level in a lower part of the dual-phase temperature range, and the work after heating is rapidly cooled down to the vicinity of room temperature as rapidly as possible. This enables maintaining of the microstructure which has been formed upon the heating and includes fine cementite particles dispersing in a considerable number in ferrite grains. The fine cementite particles remain in a considerable number in ferrite grains even after post-annealing tempering and contribute to higher hardness of ferrite.

In contrast, the resulting hard secondary phase has lower hardness. This is because the presence of the cementite particles in a considerable number in the ferrite grains causes, as a counteraction, the hard secondary phase to contain carbon in a lower content; and carbon precipitates as cementite and the fine cementite particles are coarsened in the hard secondary phase during the tempering.

Thus, the microstructure becomes a dual phase microstructure including ferrite hardened by precipitation, and a hard secondary phase from which part of carbon has been escaped. The difference in hardness between the two phases thereby decreases, and this allows the entire microstructure to have a homogeneously distributed strength.

In addition, the resulting dual phase steel has advantages as follows. Specifically, when the ferrite fraction increases, the number of cementite-containing ferrite grains increases, the carbon content in the hard secondary phase thereby decreases, and the difference in hardness between the two phases becomes smaller. When the ferrite fraction decreases contrarily, the hard secondary phase increases in amount and the carbon content in the hard secondary phase decreases by dilution, although the number of cementite-containing ferrite grains decreases, and the difference in hardness between the two phases also decreases. Accordingly, even a change in ferrite fraction contributes to smaller fluctuations in the properties.

The second annealing condition in annealing of a cold-rolled steel is as follows. Initially, heating is performed relatively slowly to allow cementite particles to be coarsened in the ferrite recrystallization process, where the cementite particles have been precipitated in the prior microstructure. The cementite particles are taken into recrystallized ferrite, and this forms a microstructure including coarse cementite particles in ferrite grains. In addition, the relatively slow heating reduces the dislocation density in ferrite sufficiently.

Next, the work is heated and held from the Ac1 point to the annealing temperature (dual-phase temperature range) to dissolve part of the coarsened cementite; and the work is rapidly cooled down to the vicinity of room temperature as rapidly as possible to enrich solute carbon in ferrite. The solute carbon enriched in ferrite remains as intact in ferrite even after post-annealing tempering, and this contributes to higher hardness of ferrite.

In contrast, the hardness of the hard secondary phase decreases. This is because the hard secondary phase has a lower carbon content due to enrichment of solute carbon in ferrite during the annealing, and carbon in the hard secondary phase precipitates as cementite and/or the fine cementite particles are coarsened during tempering.

When the steel sheet having the thus-obtained microstructure is worked, ferrite serving as a soft phase preferentially deforms, but simultaneously undergoes dynamic strain aging and thereby undergoes abrupt work hardening during plastic deformation. The resulting ferrite has a hardness near to that of the hard secondary phase whose hardness is controlled to be rather low. This allows the entire microstructure to have a homogeneously distributed strength and contributes to better ductility.

Accordingly, the steel sheet can have smaller variations in the properties even when the ferrite fraction changes, by constructing the microstructure as mentioned above.

The present inventors performed verification tests based on the thought experiments and obtained positive proof. The present invention has been made based on these findings and further investigations. The verification tests will be described in later in Experimental Examples.

The microstructure that features the steel sheet according to the present invention (hereinafter also referred to as "steel sheet according to the embodiment of the present invention") will be described initially.

Microstructure of Steel Sheet

The steel sheet according to the embodiment of the present invention is based on a dual phase microstructure including ferrite as a soft primary phase and tempered martensite or the like as a hard secondary phase, as described above. The steel sheet according to the embodiment of the present invention is particularly featured by control of size and number density of cementite particles in ferrite grains.

Soft primary phase ferrite: in an area percentage of 20% to 50%

Ferrite having high deformability (ductility) mainly contributes to deformation in the dual phase steel of ferrite-tempered martensite or the like. The elongation of the dual phase steel of ferrite-tempered martensite or the like is therefore mainly determined by the ferrite area percentage.

To surely have an elongation at a target level, the steel sheet should have a ferrite area percentage of 20% or more, preferably 25% or more, and more preferably 30% or more. However, the steel sheet, if containing ferrite in excess, may fail to have a sufficient strength. To prevent this, the steel sheet should have a ferrite area percentage of 50% or less, preferably 45% or less, and more preferably 40% or less.

Meeting one of conditions (a) and (b) as follows:

(a) cementite particles having an equivalent circle diameter of 0.05 μm to less than 0.3 μm are dispersed in the ferrite grains in a number density of greater than 0.15 to 0.50 per square micrometer of the ferrite; and (b) cementite particles having an equivalent circle diameter of 0.3 μm or more are dispersed in the ferrite grains in a number density of 0.05 to 0.15 per square micrometer of the ferrite.

Cementite particles having appropriate sizes should be present in a predetermined density in ferrite so as to help the ferrite to have a hardness near to that of the hard secondary phase. The density is hereinafter also referred to as "number density".

The first annealing condition is designed to utilize "fine cementite particles", specifically, cementite particles having an equivalent circle diameter of 0.05 μm to less than 0.3 μm. In contrast, the second annealing condition is designed to utilize "large (coarse) cementite particles", specifically, cementite particles having an equivalent circle diameter of 0.3 μm or more. The two types of cementite particles give the same advantageous effects ultimately obtained as steel sheet properties, namely, control of the variations in mechanical properties within a desired range, but differ from each other in function in the steel microstructure. In addition, the first and second annealing conditions require different conditions so as to ensure the two types of cementite particles in an appropriate number density.

The present invention therefore provides two different conditions (a) and (b) on the appropriate ferrite grain size and the number density herein. Desired advantageous effects of the present invention can be exhibited by meeting at least one of the conditions (a) and (b).

The condition (a) will initially be described.

Fine cementite particles having an equivalent circle diameter of 0.05 μm to less than 0.3 μm are desirably present in a number density of greater than 0.15, and preferably 0.20 or more, per square micrometer of ferrite so as to control the variations in mechanical properties to be within desired ranges. However, fine cementite particles, if present in excess, may adversely affect ductility. To prevent this, the number density of the fine cementite particles is adapted to be 0.50 or less, and preferably 0.45 or less, per square micrometer of ferrite.

The size (equivalent circle diameter) of fine cementite particles is specified herein to be less than 0.3 μm in terms of its upper limit. This is because cementite particles having a size of 0.3 μm or more may distribute with excessively large spaces between them, thereby fail to prevent dislocation migration, and fail to contribute to precipitation hardening. The size is specified to be 0.05 μm in terms of its lower limit. This is because cementite particles having a size of smaller than 0.05 μm may be cleaved by dislocation migration, thereby fail to sufficiently prevent dislocation migration, and also fail to contribute to precipitation hardening.

Next, the condition (b) will be described.

Coarse cementite particles having an equivalent circle diameter of 0.3 μm or more are desirably present in a number density of 0.05 or more, and preferably 0.06 or more, per square micrometer of ferrite so as to control the variations in mechanical properties to be within desired ranges. However, coarse cementite particles, if present in excess, may adversely affect ductility. To prevent this, the number density of the cementite particles is adapted to be 0.15 or less, and preferably 0.14 or less, per square micrometer of ferrite.

The size (equivalent circle diameter) of coarse cementite particles is specified herein to be 0.3 μm or more. This is because as follows. Specifically, cementite particles having a size of 0.3 μm or more may distribute with excessively large spaces between them, thereby fail to prevent dislocation migration, and fail to contribute to precipitation hardening as is described above. However, such large (coarse) cementite particles can contain Mn enriched in a higher content and, when allowed to be present in an appropriate number density, can contribute to a lower carbon content of the hard secondary phase and to a smaller difference in hardness between the hard secondary phase and the ferrite phase.

Measuring methods for the area percentages of the respective phases, and the sizes and number densities of cementite particles will be illustrated below.

Measuring Method for Area Percentages of Respective Phases

The area percentages of the respective phases are determined in the following manner. Initially, each steel sheet test sample is polished to a mirror-smooth state, etched with a 3% Nital solution to expose microstructures, and images of the microstructures are observed in five fields of view each having a size of approximately 40 μm by 30 μm with a scanning electron microscope (SEM) at 2000-fold magnification. The measurement is performed at 100 points per one field of view by point counting to determine the area of ferrite. The images are analyzed, based on which a region containing cementite is defined as a hard secondary phase, and the other regions are defined as retained austenite, martensite, and a microstructure as a mixture of retained austenite and martensite. The area percentages of the respective phases are calculated from the area percentages of the respective regions.

Measuring Method for Sizes and Number Densities of Cementite Particles

The sizes and number densities of cementite particles are measured in a manner as follows.

An extraction replica sample is initially prepared from each steel sheet test sample. Transmission electron microscopic (TEM) images at 20000-fold magnification are observed in three fields of view having a size of 6 μm by 4 μm for the microstructure under the condition (a); whereas TEM images at 10000-fold magnification are observed in three fields of view having a size of 12 μm by 8 μm for the microstructure under the condition (b).

White regions in the TEM images are defined and marked as cementite particles based on the contrast of the images. The area A of each of the marked cementite particles is determined using an image analyzing software, from which the equivalent circle diameter D is calculated as: $D=2\times(A/$ $\pi)^{1/2}$ and the number of cementite particles having the predetermined size present in unit area is determined. A region where two or more cementite particles are overlapped is excluded from the observation objects.

Next, the chemical composition of the steel sheet according to the embodiment of the present invention will be described. The chemical composition is indicated hereinafter in mass percent.

Chemical Composition of Steel Sheet According to Embodiment of Present Invention C in a Content of 0.05% to 0.30%

Carbon (C) element affects the area percentage of the hard secondary phase and the amount of cementite present in ferrite, and importantly affects the strength, elongation, and stretch flangeability. Carbon, if present in a content of less than 0.05%, may fail to contribute to a strength at certain level. In contrast, carbon, if present in a content of greater than 0.30%, may adversely affect weldability. The carbon content is preferably 0.10% to 0.25%, and more preferably 0.14% to 0.20%.

Si in a Content of Greater than 0% to 3.0%

Silicon (Si) element strengthens ferrite by solute strengthening, can thereby reduce the difference in strength between ferrite and the hard secondary phase, and usefully contributes to elongation and stretch flangeability both at satisfactory levels. Si, if present in a content greater than 3.0%, may impede austenite formation upon heating and cause the steel sheet to fail to have a predetermined area percentage of the hard secondary phase and to ensure stretch flangeability at certain level. The Si content is preferably 0.50% to 2.5%, and more preferably 1.0% to 2.2%.

Mn in a Content of 0.1% to 5.0%

Manganese (Mn) element helps the hard secondary phase to have better deformability (ductility) and thereby contributes to elongation and stretch flangeability both at satisfactory levels. In addition, Mn contributes to better hardenability and advantageously widens the range of manufacturing conditions under which the hard secondary phase can be obtained. Mn, if present in a content of less than 0.1%, may fail to exhibit the actions sufficiently and fail to contribute to elongation and stretch flangeability both at satisfactory levels. In contrast, Mn, if present in a content of greater than 5.0%, may cause an excessively low reverse transformation temperature to impede recrystallization, and fail to ensure good balance between strength and elongation. The Mn content is preferably 0.50% to 2.5%, and more preferably 1.2% to 2.2%.

P in a Content of Greater than 0% to 0.1%

Phosphorus (P) element is inevitably present as an impurity element and contributes to a higher strength by solute strengthening. The element, however, segregates at a prior austenite grain boundary, embrittles the grain boundary, and thereby degrades stretch flangeability. To prevent this, the phosphorus content is desirably 0.1% or less, preferably 0.05% or less, and more preferably 0.03% or less.

S in a Content of Greater than 0% to 0.02%

Sulfur (S) element is also inevitably present as an impurity element, forms MnS inclusions, and causes cracking upon bore expanding to degrade stretch flangeability. To prevent this, the sulfur content is desirably 0.02% or less, preferably 0.015% or less, and more preferably 0.010% or less.

Al in a Content of 0.01% to 1.0%

Aluminum (Al) element is added as a deoxidizer and advantageously allows inclusions to be finer. In addition, the element strengthens ferrite by solute strengthening and advantageously reduces the difference in strength between ferrite and the hard secondary phase. Al, if present in a content of less than 0.01%, may cause the steel to undergo strain aging due to residual solute nitrogen in the steel and fail to contribute to satisfactory elongation and stretch flangeability. In contrast, Al, if present in a content of greater than 1.0%, may often cause inclusions in the steel to act as fracture origins and fail to contribute to satisfactory stretch flangeability.

N in a Content of Greater than 0% to 0.01%

Nitrogen (N) element is also inevitably present as an impurity element. The element may often cause internal defects to degrade elongation and stretch flangeability. To prevent this, the nitrogen content is preferably minimized and is desirably 0.01% or less.

The steel for use in the present invention basically contains the elements, with the remainder including iron and impurities. The steel may further contain one or more of acceptable elements as follows, within a range not adversely affecting the operation of the present invention.

Cr in a Content of 0.01% to 1.0%

Chromium (Cr) element strengthens ferrite by solute strengthening, can thereby reduce the difference in strength between ferrite and the hard secondary phase, and usefully contributes to better stretch flangeability. Cr, if added in a content of less than 0.01%, may fail to effectively exhibit the actions. In contrast, Cr, if added in a content of greater than 1.0%, may form coarse $Cr_7C_3$ to degrade stretch flangeability.

At least one element selected from the group consisting of:

Mo in a content of 0.01% to 1.0%;

Cu in a content of 0.05% to 1.0%; and

Ni in a content of 0.05% to 1.0%

These elements usefully contribute to a higher strength by solute strengthening without degrading formability. Each of the elements may fail to effectively exhibit the actions if added in a content of lower than the lower limit; whereas it may cause excessively high cost if added in a content of greater than 1.0%.

At least one element selected from the group consisting of:

Ca in a content of 0.0001% to 0.01%;

Mg in a content of 0.0001% to 0.01%;

Li in a content of 0.0001% to 0.01%; and a REM or REMs in a content of 0.0001% to 0.01%

These elements usefully allow inclusions to be fine, reduce fracture origins, and contribute to better stretch flangeability. Each of the elements, if added in a content of less than 0.0001%, may fail to effectively exhibit the actions. In contrast, each of the elements, if added in a content of greater than 0.01%, may cause inclusions to be coarsened contrarily and thereby degrade stretch flangeability.

The term "REM" refers to a rare-earth element, namely an element belonging to Group 3A in the periodic table.

Next, a preferred method for manufacturing the steel sheet according to the present invention will be illustrated below.

Preferred Method for Manufacturing Steel Sheet

To manufacture the cold-rolled steel sheet as mentioned above, a steel having the chemical composition is initially prepared, formed into a slab by ingot making or continuous casting, and the slab is subjected to hot rolling. The hot rolling is performed under a condition as follows. Specifically, the work (slab) is subjected to hot rolling with a preset finish rolling end temperature of equal to or higher than the Ara point, cooled appropriately, and coiled at a temperature of 450° C. to 600° C. After the completion of hot rolling, the work is acid-washed and then subjected to cold rolling. The cold rolling is preferably performed to a cold rolling reduction of 20% to 50%.

After the cold rolling, the work is successively subjected to annealing under either one of the first and second annealing conditions as follows and further subjected to tempering.

First Annealing Condition

The annealing under the first annealing condition may be preferably performed by heating the work from room temperature up to 600° C. at a first heating rate of greater than 5.0° C./s to 10.0° C./s and further heating the work from 600° C. up to an annealing temperature at a second heating rate half the first heating rate or less; holding the work at the annealing temperature of Ac1 to lower than (Ac1+Ac3)/2 for an annealing holding time of 3600 seconds or shorter; slowly cooling the work from the annealing temperature down to a first cooling end temperature (slow cooling end temperature) of 730° C. to 500° C. at a first cooling rate (slow cooling rate) of 1° C./s to less than 50° C./s; and rapidly cooling the work down to a second cooling end temperature (rapid cooling end temperature) of the Ms point or lower at a second cooling rate (rapid cooling rate) of 50° C./or more.

Heating from Room Temperature Up to 600° C. at First Heating Rate of Greater than 5.0° C./s to 10.0° C./s In annealing, the cold-rolled steel is initially heated at a predetermined heating rate in the heating process. The process is performed so as to cause ferrite recrystallization and to allow fine cementite particles to remain in a considerable number in ferrite.

To effectively exhibit the actions, the first heating rate is preferably greater than 5.0° C./s, and more preferably 6.0° C./s or more. However, heating, if performed at an excessively low first heating rate, may cause cementite particles to be coarsened. Heating, if performed at an excessively high first heating rate, may cause fine cementite particles to be present insufficiently in ferrite grains and impede sufficient control of the variations in the properties. To prevent this, the first heating rate is preferably 10.0° C./s or less, and more preferably 9.0° C./s or less.

Heating from 600° C. Up to Annealing Temperature at Second Heating Rate Half the First Heating Rate or Less Next, the work is heated and held from 600° C. to the annealing temperature (dual-phase temperature range) for a predetermined time so as to dissolve part of the considerable number of fine cementite particles to thereby adjust the number density of the fine cementite particles appropriately.

To effectively exhibit the actions, the second heating rate is preferably half the first heating rate or less, and more preferably one third the first heating rate or less.

Holding at Annealing Temperature of Ac1 to Lower than (Ac1+Ac3)/2 for Annealing Holding Time of 3600 Seconds or Shorter The holding (annealing heating) is performed to cause transformation to austenite in an area percentage of 20% or more so as to form a hard secondary phase in a sufficient amount by transformation during the subsequent cooling.

Holding, if performed at an annealing temperature of lower than Ac1, may not induce transformation to austenite. In contrast, holding, if performed at an annealing temperature of (Ac1+Ac3)/2 or higher, may cause all the cementite particles to be dissolved, and this may cause tempered martensite or the like to have higher hardness and cause the steel sheet to have inferior ductility. The upper limit of the annealing temperature is more preferably (2Ac1+Ac3)/3, and particularly preferably (3Ac1+Ac3)/4.

Holding, if performed for an annealing holding time of longer than 3600 seconds, may extremely degrade productivity, thus being undesirable. The lower limit of the annealing holding time is more preferably 60 seconds.

Slow Cooling Down to First Cooling End Temperature of 730° C. to 500° C. at First Cooling Rate of 1° C./s to Less than 50° C./s The slow cooling condition is specified so as to form ferrite microstructure in an area percentage of 20% to 50%. This helps the steel sheet to have better elongation while ensuring stretch flangeability at certain level.

Cooling, if performed to a temperature of lower than 500° C. or if performed at a cooling rate of less than 1° C./s, may cause excessive ferrite formation, and this may cause the steel sheet to fail to have strength and stretch flangeability at satisfactory levels.

Rapid Cooling Down to Second Cooling End Temperature of Ms Point or Lower at Second Cooling Rate of 50° C./s or More The process is performed to impede formation of ferrite from austenite during cooling and to thereby yield the hard secondary phase.

Rapid cooling, if finished at a temperature higher than Ms point (martensitic transformation start temperature) or if performed at a cooling rate of less than 50° C./s, may cause austenite to remain even at room temperature, and this may cause the steel sheet to have insufficient stretch flangeability.

Second Annealing Condition

The annealing under the second annealing condition may be preferably performed by heating the work from mom temperature up to 600° C. at a first heating rate of 0.5° C./s to 5.0° C./s; further heating the work from 600° C. up to an annealing temperature at a second heating rate half the first heating rate or less; holding the work at an annealing temperature of (Ac1+Ac3)/2 to Ac3 for an annealing holding time of 3600 seconds or shorter, slowly cooling the work from the annealing temperature down to a first cooling end temperature (slow cooling end temperature) of 730° C. to 500° C. at a first cooling rate (slow cooling rate) of 1° C./s to less than 50° C./s; and rapidly cooling the work down to a second cooling end temperature (rapid cooling end temperature) of Ms point or lower at a second cooling rate (rapid cooling rate) of 50° C./s or more.

Heating from Room Temperature Up to 600° C. at First Heating Rate of 0.5° C./s to 5.0° C./s The cold-rolled steel in annealing is initially relatively slowly heated. The heating is performed so that cementite particles already precipitated in the prior microstructure are coarsened during the ferrite recrystallization process; and the coarsened cementite particles are taken into recrystallized ferrite to form a microstructure including large (coarse) cementite particles present in ferrite grains. In addition, the heating can contribute to sufficient reduction of dislocation density in ferrite.

To effectively exhibit the actions, the first heating rate is preferably 5.0° C./s or less, and more preferably 4.8° C./s or less. However, heating, if performed at an excessively low first heating rate, may cause excessively coarsened cementite particles and may degrade ductility. To prevent this, the first heating rate is preferably 0.5° C./s or more, and more preferably 1.0° C./s or more.

Heating from 600° C. Up to Annealing Temperature at Second Heating Rate Half the First Heating Rate or Less Next, the work is heated and held in a temperature range of the Ad point up to an annealing temperature (dual-phase temperature range) for a predetermined time. The heating is performed to dissolve part of the coarsened cementite particles to thereby allow solute carbon to be enriched in ferrite during the subsequent rapid cooling down to the vicinity of room temperature.

To effectively exhibit the actions, the second heating rate is preferably half the first heating rate or less, and more preferably one third the first heating rate or less.

Holding at Annealing Temperature of (Ac1+Ac3)/2 to Ac3 for Annealing Holding Time of 3600 Seconds or Shorter The holding (annealing heating) is performed to cause transformation to austenite in an area percentage of 20% or more so as to form a hard secondary phase in a sufficient amount by transformation during the subsequent cooling.

Holding, if performed at an annealing temperature of lower than (Ac1+Ac3)/2, may cause cementite to be dissolved insufficiently and to remain as coarse, and this may degrade ductility. In contrast, holding, if performed at an annealing temperature of higher than Ac3 (transformation end temperature), may cause cementite to be dissolved completely, and this may cause tempered martensite or the like to have higher hardness, resulting in inferior ductility.

Holding, if performed for an annealing holding time of longer than 3600 seconds, may cause extremely inferior productivity, thus being undesirable. The lower limit of the annealing holding time is more preferably 60 seconds. The holding for such a long annealing heating time may contribute to strain removal in ferrite.

Slow Cooling Down to First Cooling End Temperature of 730° C. to 500° C. at First Cooling Rate of 1° C./s to Less than 50° C./s The slow cooling under the condition is performed to form ferrite microstructure in an area percentage of 20% to 50% to thereby contribute to better elongation, while ensuring stretch flangeability at certain level.

Slow cooling, if performed down to a temperature of lower than 500° C. or performed at a cooling rate of less than 1° C./s, may cause excessive ferrite formation, and this may cause the steel sheet to fail to have strength and stretch flangeability at satisfactory levels.

Rapid Cooling Down to Second Cooling End Temperature of Ms Point or Lower at Second Cooling Rate of 50° C./s or More The rapid cooling under the condition is performed to impede formation of ferrite from austenite during cooling to thereby yield a hard secondary phase.

Rapid cooling, if completed at a temperature higher than the Ms point or if performed at a cooling rate of less than 50° C./s, may cause austenite to remain even at room temperature, and this may cause the steel sheet to have unsatisfactory stretch flangeability.

Tempering Condition

The tempering may preferably be performed by heating the work from the temperature after the annealing and cooling up to a tempering temperature of 300° C. to 500° C.; allowing the work to exist in a temperature range of 300° C. to the tempering temperature for a tempering holding time of 60 to 1200 seconds; and then cooling the work.

The annealing is performed so as to allow fine cementite particles to remain in ferrite or so as to allow solute carbon to be enriched in ferrite. The subsequent tempering is performed under the specific condition to allow the fine cementite particles or the enriched solute carbon in ferrite to remain as intact in ferrite even after tempering to thereby help ferrite to have higher hardness. In contrast, the enrichment of carbon in ferrite during the annealing causes, as a counteraction, the hard secondary phase to have a lower carbon content. The subsequent tempering is performed so as to cause the hard secondary phase to have lower hardness (to be softened) by causing carbon to further precipitate as cementite from the hard secondary phase and/or causing fine cementite particles to be coarsened.

Tempering, if performed at a tempering temperature of lower than 300° C. or if performed for a tempering time of shorter than 60 seconds, may fail to contribute to softening of the hard secondary phase. In contrast, tempering, if performed at a tempering temperature of higher than 500° C., may cause the hard secondary phase to be excessively softened to cause the steel sheet to have an insufficient strength, or may cause cementite particles to be excessively coarsened to degrade stretch flangeability. Tempering, if performed for a tempering time of longer than 1200 seconds, may undesirably cause inferior productivity.

The tempering temperature is more preferably 320° C. to 480° C., and the tempering holding time is more preferably 120 to 600 seconds.

EXAMPLES

First Experimental Example

Experimental Example on Microstructure Condition (a) and First Annealing Condition Ingots having a thickness of 120 mm were made from molten steels having different chemical compositions given in Table 1 below. The ingots were hot-rolled to a thickness of 25 mm, and hot-rolled again to a thickness of 3.2 mm at a finish rolling end temperature of 800° C. to 1000° C. and a coiling temperature of 450° C. to 600° C. The resulting works were acid-washed, cold-rolled to a thickness of 1.6 mm and yielded cold-rolled steel sheets as test samples. The test samples were subjected to heat treatments under conditions given in Tables 2 to 4 (see the heat treatment pattern in FIG. 1).

Ac1 and Ac3 in Table 1 were determined according to Expressions 1 and 2 as follows (see "The Physical Metallurgy of Steels", William C. Leslie (Japanese translation, translated under the supervision of Kouda Shigeyasu, p. 273 (1985), Maruzen Co., Ltd.).

$$Ac1\ (^\circ C.)=723+29.1[Si]-10.7[Mn]+16.9[Cr]-16.9[Ni] \quad \text{Expression 1}$$

$$Ac3(^\circ C.)=910-203\sqrt{[C]}+44.7[Si]+31.5[Mo]-15.2[Ni] \quad \text{Expression 2}$$

where [X] represents a content (in mass percent) of each element.

TABLE 1

| Steel | Chemical composition (in mass percent) [with the remainder including Fe and inevitable impurities] | | | | | | | | Ac1 | Ac3 | (Ac1 + Ac3)/2 |
|---|---|---|---|---|---|---|---|---|---|---|---|
| type | C | Si | Mn | P | S | Al | N | Other element | (° C.) | (° C.) | (° C.) |
| 1A | 0.16 | 1.22 | 1.53 | 0.002 | 0.003 | 0.043 | 0.0044 | Ni: 0.07 | 741 | 882 | 812 |
| 1B | 0.12 | 1.21 | 5.31 | 0.002 | 0.003 | 0.040 | 0.0042 | — | 701 | 894 | 798 |
| 1C | 0.17 | 1.21 | 1.81 | 0.004 | 0.003 | 0.046 | 0.0047 | Ca: 0.0008, REM: 0.0013 | 739 | 880 | 810 |

TABLE 1-continued

| Steel type | Chemical composition (in mass percent) [with the remainder including Fe and inevitable impurities] C | Si | Mn | P | S | Al | N | Other element | Ac1 (° C.) | Ac3 (° C.) | (Ac1 + Ac3)/2 (° C.) |
|---|---|---|---|---|---|---|---|---|---|---|---|
| 1D | 0.18 | 3.22 | 1.43 | 0.002 | 0.003 | 0.032 | 0.0045 | Ca: 0.0010 | 801 | 968 | 885 |
| 1E | 0.23 | 1.20 | 1.60 | 0.002 | 0.004 | 0.043 | 0.0050 | Ca: 0.0006 | 741 | 866 | 804 |
| 1F | 0.14 | 1.17 | 1.83 | 0.002 | 0.002 | 0.036 | 0.0039 | Cu: 0.44 | 737 | 886 | 812 |
| 1G | 0.19 | 1.28 | 1.49 | 0.000 | 0.003 | 0.037 | 0.0031 | Cr: 0.06, Ca: 0.0007 | 745 | 879 | 812 |
| 1H | 0.14 | 1.41 | 1.91 | 0.000 | 0.005 | 0.036 | 0.0030 | Ni: 0.31, Ca: 0.0006 | 738 | 892 | 815 |
| 1I | 0.19 | 1.44 | 1.88 | 0.003 | 0.004 | 0.036 | 0.0048 | Cr: 0.25, Ca: 0.0011 | 749 | 886 | 817 |
| 1J | 0.15 | 1.22 | 0.03 | 0.001 | 0.001 | 0.046 | 0.0035 | Ca: 0.0005 | 758 | 886 | 822 |
| 1K | 0.16 | 1.42 | 1.49 | 0.001 | 0.019 | 0.034 | 0.0037 | Ca: 0.0009 | 748 | 892 | 820 |
| 1L | 0.12 | 0.15 | 1.51 | 0.004 | 0.004 | 0.047 | 0.0032 | Ca: 0.0012 | 711 | 846 | 779 |
| 1M | 0.17 | 1.25 | 1.42 | 0.003 | 0.002 | 0.039 | 0.0045 | Ca: 0.0005, Mg: 0.0005 | 744 | 882 | 813 |
| 1N | 0.34 | 1.38 | 1.82 | 0.001 | 0.004 | 0.038 | 0.0046 | Ca: 0.0009 | 744 | 853 | 799 |
| 1O | 0.15 | 1.26 | 1.57 | 0.003 | 0.003 | 0.033 | 0.0041 | Ca: 0.0005 | 743 | 888 | 815 |
| 1P | 0.12 | 1.32 | 1.83 | 0.002 | 0.002 | 0.033 | 0.0039 | — | 742 | 899 | 820 |
| 1Q | 0.13 | 1.32 | 2.09 | 0.003 | 0.010 | 0.039 | 0.0054 | — | 739 | 896 | 817 |
| 1R | 0.17 | 1.31 | 1.61 | 0.004 | 0.005 | 0.038 | 0.0035 | Cu: 0.07, Ca: 0.0008 | 744 | 885 | 814 |
| 1S | 0.14 | 1.29 | 1.87 | 0.002 | 0.001 | 0.044 | 0.0051 | Ca: 0.0007, Mg: 0.0006 | 741 | 892 | 816 |
| 1T | 0.17 | 2.08 | 1.80 | 0.003 | 0.000 | 0.036 | 0.0039 | — | 764 | 919 | 842 |
| 1U | 0.03 | 1.27 | 2.13 | 0.003 | 0.001 | 0.044 | 0.0028 | — | 737 | 932 | 834 |
| 1V | 0.13 | 1.27 | 2.18 | 0.003 | 0.000 | 0.041 | 0.0043 | Mo: 0.12 | 737 | 897 | 817 |
| 1W | 0.14 | 1.36 | 1.60 | 0.001 | 0.002 | 0.032 | 0.0036 | Mo: 0.06, Ca: 0.0013 | 745 | 897 | 821 |
| 1X | 0.20 | 1.32 | 1.57 | 0.003 | 0.002 | 0.047 | 0.0047 | REM: 0.0006 | 745 | 878 | 811 |
| 1Y | 0.18 | 1.36 | 1.59 | 0.002 | 0.002 | 0.046 | 0.0030 | Ca: 0.0002, Li: 0.0009 | 746 | 885 | 815 |
| 1Z | 0.17 | 1.28 | 2.14 | 0.009 | 0.003 | 0.043 | 0.0034 | Ca: 0.0007 | 737 | 884 | 810 |
| 2A | 0.15 | 1.16 | 1.37 | 0.002 | 0.005 | 0.038 | 0.0027 | Li: 0.0004 | 742 | 883 | 813 |
| 2B | 0.15 | 1.20 | 2.11 | 0.015 | 0.000 | 0.039 | 0.0041 | Mg: 0.0012 | 735 | 885 | 810 |
| 2C | 0.13 | 1.25 | 3.46 | 0.002 | 0.005 | 0.038 | 0.0054 | Ca: 0.0012 | 722 | 893 | 808 |
| 2D | 0.16 | 1.18 | 1.81 | 0.001 | 0.000 | 0.041 | 0.0043 | Li: 0.0018 | 738 | 882 | 810 |
| 2E | 0.17 | 1.29 | 2.08 | 0.024 | 0.002 | 0.033 | 0.0056 | — | 738 | 884 | 811 |
| 2F | 0.16 | 1.24 | 1.18 | 0.001 | 0.005 | 0.043 | 0.0041 | — | 746 | 884 | 815 |
| 2G | 0.16 | 1.28 | 1.98 | 0.003 | 0.003 | 0.033 | 0.0044 | — | 739 | 886 | 813 |

(Underlined data: out of the scope of the present invention, —: less than detection limt)

TABLE 2

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 1 | 1A | 6.3 | 2.8 | 0.44 | 800 | 120 | 10 | 600 | 50 | 60 | 450 | 300 |
| 2 | | 7.8 | 3.5 | 0.45 | 800 | 120 | 10 | 600 | 50 | 60 | 450 | 300 |
| 3 | 1B | 6.3 | 2.8 | 0.44 | 775 | 120 | 10 | 650 | 50 | 60 | 450 | 300 |
| 4 | | 6.3 | 2.8 | 0.44 | 775 | 120 | 10 | 600 | 50 | 60 | 450 | 300 |
| 5 | 1C | 6.3 | 2.8 | 0.44 | 800 | 120 | 10 | 600 | 50 | 60 | 450 | 300 |
| 6 | | 6.3 | 2.8 | 0.44 | 785 | 120 | 10 | 600 | 50 | 60 | 450 | 300 |
| 7 | 1D | 6.3 | 2.8 | 0.44 | 850 | 120 | 10 | 650 | 50 | 60 | 425 | 300 |
| 8 | 1E | 6.3 | 2.8 | 0.44 | 800 | 120 | 10 | 600 | 50 | 60 | 400 | 300 |
| 9 | | 6.3 | 2.8 | 0.44 | 800 | 150 | 10 | 600 | 50 | 60 | 400 | 300 |
| 10 | 1F | 6.3 | 2.8 | 0.44 | 800 | 120 | 10 | 600 | 50 | 60 | 450 | 300 |
| 11 | | 6.3 | 2.8 | 0.44 | 800 | 120 | 12 | 600 | 50 | 60 | 450 | 300 |
| 12 | 1G | 6.3 | 2.8 | 0.44 | 800 | 120 | 10 | 650 | 50 | 60 | 450 | 300 |
| 13 | | 6.3 | 2.8 | 0.44 | 800 | 120 | 10 | 625 | 50 | 60 | 450 | 300 |
| 14 | 1H | 6.3 | 2.8 | 0.44 | 800 | 120 | 10 | 600 | 50 | 60 | 450 | 300 |
| 15 | | 6.3 | 2.8 | 0.44 | 800 | 120 | 10 | 600 | 80 | 60 | 450 | 300 |
| 16 | 1I | 6.3 | 2.8 | 0.44 | 800 | 120 | 10 | 650 | 50 | 60 | 425 | 300 |
| 17 | | 6.3 | 2.8 | 0.44 | 800 | 120 | 10 | 650 | 50 | 35 | 425 | 300 |
| 18 | 1J | 6.3 | 2.8 | 0.44 | 800 | 120 | 10 | 650 | 50 | 60 | 400 | 300 |
| 19 | 1K | 6.3 | 2.8 | 0.44 | 800 | 120 | 10 | 600 | 50 | 60 | 450 | 300 |
| 20 | | 6.3 | 2.8 | 0.44 | 800 | 120 | 10 | 600 | 50 | 60 | 425 | 300 |
| 21 | 1L | 6.3 | 2.8 | 0.44 | 775 | 120 | 10 | 600 | 50 | 60 | 450 | 300 |
| 22 | | 6.3 | 2.8 | 0.44 | 775 | 120 | 10 | 600 | 50 | 60 | 450 | 450 |
| 23 | 1M | 6.3 | 2.8 | 0.44 | 800 | 120 | 10 | 600 | 50 | 60 | 450 | 300 |
| 24 | | 6.3 | 2.8 | 0.44 | 775 | 120 | 10 | 625 | 50 | 60 | 450 | 300 |
| 25 | 1N | 6.3 | 2.8 | 0.44 | 775 | 120 | 10 | 600 | 50 | 60 | 450 | 300 |
| 26 | 1O | 6.3 | 2.8 | 0.44 | 800 | 120 | 10 | 650 | 50 | 60 | 450 | 300 |
| 27 | | 7.4 | 2.8 | 0.38 | 775 | 120 | 10 | 650 | 50 | 60 | 450 | 300 |

TABLE 2-continued

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 28 | 1P | 6.3 | 2.8 | 0.44 | 800 | 120 | 10 | 650 | 50 | 60 | 450 | 300 |
| 29 | | 6.3 | 2.8 | 0.44 | 815 | 120 | 10 | 625 | 50 | 60 | 450 | 300 |
| 30 | 1Q | 6.3 | 2.8 | 0.44 | 800 | 120 | 10 | 650 | 50 | 60 | 450 | 300 |
| 31 | | 6.3 | 2.8 | 0.44 | 785 | 120 | 10 | 600 | 50 | 60 | 425 | 300 |

(Underlined data: out of the scope of the present invention)

TABLE 3

(continued from Table 2)

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling temperature (° C.) | Tempering condition: Tempering temperature (° C.) | Tempering holding time (s) |
|---|---|---|---|---|---|---|---|---|---|---|---|---|
| 32 | 1R | 6.3 | 2.8 | 0.44 | 800 | 120 | 10 | 600 | 50 | 60 | 400 | 300 |
| 33 | 1S | 6.3 | 2.8 | 0.44 | 800 | 120 | 10 | 600 | 50 | 60 | 450 | 300 |
| 34 | 1T | 6.3 | 2.8 | 0.44 | 825 | 120 | 10 | 600 | 50 | 60 | 450 | 300 |
| 35 | 1U | 6.3 | 2.8 | 0.44 | 825 | 120 | 10 | 600 | 50 | 60 | 450 | 300 |
| 36 | 1V | 6.3 | 2.8 | 0.44 | 800 | 120 | 10 | 650 | 50 | 60 | 450 | 300 |
| 37 | 1W | 6.3 | 2.8 | 0.44 | 800 | 120 | 10 | 600 | 50 | 60 | 425 | 300 |
| 38 | 1X | 6.3 | 2.8 | 0.44 | 800 | 120 | 10 | 600 | 50 | 60 | 450 | 300 |
| 39 | 1Y | 6.3 | 2.8 | 0.44 | 800 | 120 | 10 | 600 | 50 | 60 | 425 | 300 |
| 40 | 1Z | 6.3 | 2.8 | 0.44 | 800 | 120 | 10 | 650 | 50 | 60 | 450 | 300 |
| 41 | 2A | 6.3 | 2.8 | 0.44 | 800 | 120 | 10 | 650 | 50 | 60 | 450 | 300 |
| 42 | 2B | 6.3 | 2.8 | 0.44 | 800 | 120 | 10 | 600 | 50 | 60 | 425 | 300 |
| 43 | 2C | 6.3 | 2.8 | 0.44 | 800 | 120 | 10 | 650 | 50 | 60 | 450 | 300 |
| 44 | 2D | 6.3 | 2.8 | 0.44 | 800 | 120 | 10 | 650 | 50 | 60 | 450 | 300 |
| 45 | 2E | 6.3 | 2.8 | 0.44 | 800 | 120 | 10 | 650 | 50 | 60 | 425 | 300 |
| 46 | 2F | 6.3 | 2.8 | 0.44 | 800 | 120 | 10 | 600 | 50 | 60 | 450 | 300 |

(Underlined data: out of the scope of the present invention)

TABLE 4

(continued from Table 3)

| Heat treatment number | Steel type | Annealing condition: First heating rate HR1 (° C./s) | Second heating rate HR2 (° C./s) | HR2/HR1 (—) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 47 | 2G | 5.2 | 1.8 | 0.35 | 800 | 120 | 10 | 600 | 50 | 60 | 450 | 300 |
| 48 | | 9.5 | 2.8 | 0.29 | 800 | 120 | 10 | 650 | 50 | 60 | 450 | 300 |
| 49 | | 6.3 | 1.0 | 0.16 | 800 | 120 | 10 | 650 | 50 | 60 | 450 | 300 |
| 50 | | 5.3 | 5.3 | 1.00 | 800 | 120 | — | 800 | 100 | 60 | 525 | 300 |
| 51 | | 6.3 | 0.3 | 0.05 | 800 | 120 | 10 | 600 | 50 | 60 | 450 | 300 |
| 52 | | 6.3 | 5.2 | 0.83 | 800 | 120 | 10 | 650 | 50 | 60 | 450 | 300 |
| 53 | | 6.3 | 2.8 | 0.44 | 775 | 120 | 10 | 650 | 50 | 60 | 450 | 300 |
| 54 | | 6.3 | 2.8 | 0.44 | 825 | 120 | 10 | 600 | 50 | 60 | 450 | 300 |
| 55 | | 6.3 | 2.8 | 0.44 | 900 | 120 | 10 | 600 | 50 | 60 | 450 | 300 |
| 56 | | 6.3 | 2.8 | 0.44 | 800 | 90 | 10 | 650 | 50 | 60 | 450 | 300 |
| 57 | | 6.3 | 2.8 | 0.44 | 800 | 180 | 10 | 600 | 50 | 60 | 450 | 300 |
| 58 | | 6.3 | 2.8 | 0.44 | 800 | 120 | 5 | 650 | 50 | 60 | 450 | 300 |

TABLE 4-continued (continued from Table 3)

| Heat treatment number | Steel type | Annealing condition: First heating rate HR1 (° C./s) | Second heating rate HR2 (° C./s) | HR2/HR1 (—) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 59 | | 6.3 | 2.8 | 0.44 | 800 | 120 | 20 | 600 | 50 | 60 | 450 | 300 |
| 60 | | 6.3 | 2.8 | 0.44 | 800 | 120 | 10 | 550 | 50 | 60 | 450 | 300 |
| 61 | | 6.3 | 2.8 | 0.44 | 800 | 120 | 10 | 750 | 50 | 60 | 450 | 300 |
| 62 | | 6.3 | 2.8 | 0.44 | 800 | 120 | 10 | 600 | 50 | 60 | 250 | 300 |
| 63 | | 6.3 | 2.8 | 0.44 | 800 | 120 | 10 | 650 | 50 | 60 | 350 | 300 |
| 64 | | 6.3 | 2.8 | 0.44 | 800 | 120 | 10 | 600 | 50 | 60 | 550 | 300 |
| 65 | | 6.3 | 2.8 | 0.44 | 800 | 120 | 10 | 650 | 50 | 60 | 450 | 200 |
| 66 | | 6.3 | 2.8 | 0.44 | 800 | 120 | 10 | 600 | 50 | 60 | 450 | 400 |
| 67 | | 6.3 | 2.8 | 0.44 | 800 | 120 | 10 | 700 | 50 | 60 | 425 | 300 |
| 68 | | 6.3 | 2.8 | 0.44 | 800 | 120 | 10 | 675 | 50 | 60 | 425 | 300 |
| 69 | | 6.3 | 2.8 | 0.44 | 800 | 120 | 10 | 650 | 50 | 60 | 425 | 300 |
| 70 | | 6.3 | 2.8 | 0.44 | 800 | 120 | 10 | 625 | 50 | 60 | 425 | 300 |
| 71 | | 6.3 | 2.8 | 0.44 | 800 | 120 | 10 | 600 | 50 | 60 | 425 | 300 |
| 72 | | 12.0 | 5.2 | 0.43 | 800 | 120 | 10 | 700 | 50 | 60 | 425 | 300 |
| 73 | | 12.0 | 5.2 | 0.43 | 800 | 120 | 10 | 675 | 50 | 60 | 425 | 300 |
| 74 | | 12.0 | 5.2 | 0.43 | 800 | 120 | 10 | 650 | 50 | 60 | 425 | 300 |
| 75 | | 12.0 | 5.2 | 0.43 | 800 | 120 | 10 | 625 | 50 | 60 | 425 | 300 |
| 76 | | 12.0 | 5.2 | 0.43 | 800 | 120 | 10 | 600 | 50 | 60 | 425 | 300 |

(Underlined data: out of the scope of the present invention)

The area percentages of the respective phases, and the sizes and the number densities of cementite particles were measured on the respective steel sheets after the heat treatments by the measuring methods as described above.

The tensile strength TS, elongation EL, and stretch flangeability λ were measured on the respective steel sheets after the heat treatments to evaluate the properties of the steel sheets. In addition, how much the properties varied depending on the changes of the heat treatment conditions was determined to evaluate the stability of the properties of the steel sheets.

Specifically, the properties of the steel sheets after the heat treatments were evaluated in a manner as follows. Samples meeting all the conditions, i.e., a tensile strength TS of 980 MPa or more, an elongation EL of 13% or more, and a stretch flangeability λ of 40% or more, were evaluated as accepted (having acceptable properties) (○); and the other samples were evaluated as rejected (x).

The property stability of the respective steel sheets after heat treatments was evaluated by performing heat treatments on test samples of the same steel type while varying the heat treatment condition within a maximum fluctuation range of heat treatment condition of actual equipment. Samples meeting all the conditions: a ΔTS of 200 MPa or less, a ΔEL of 2% or less, and a Δλ of 20% or less, were evaluated as accepted (having acceptable stability in the properties) (○); and the other samples were evaluated as rejected (x), where the ΔTS, ΔEL, and Δλ are variation widths of TS, EL, and λ, respectively.

The tensile strength TS and elongation EL were measured by preparing a No. 5 test specimen prescribed in Japanese Industrial Standard (JIS) Z 2201 with its long axis in a direction perpendicular to the rolling direction; and subjecting the test specimen to measurements according to JIS Z 2241. The stretch flangeability λ was determined by performing a bore expanding test according to The Japan Iron and Steel Federation Standard (JFS) T1001 to measure a bore expansion ratio; and defining this as the stretch flangeability.

Measurement results are indicated in Tables 5 to 7.

The tables demonstrate that Steel Sheets Nos. 1, 2, 5, 6, 8 to 17, 19 to 24, 26 to 31, and 67 to 71 were steel sheets according to the embodiment of the present invention meeting all conditions specified in the present invention. The tables also demonstrate that all the steel sheets according to the embodiments of the present invention were homogeneous cold-rolled steel sheets not only having excellent absolute values of the mechanical properties, but also having smaller variations in the mechanical properties.

Steel Sheets Nos. 32 to 34, 36 to 49, 51, 53, 54, 56 to 60, 63, 65, and 66 also met all the conditions specified in the present invention. The steel sheets were verified to have excellent absolute values of the mechanical properties, but their variations in mechanical properties were not yet evaluated. It is analogized, however, that the steel sheets also have small variations in mechanical properties at acceptable levels as with the steel sheets according to the embodiments of the present invention.

In contrast, steel sheets as comparative examples (hereinafter also briefly referred to as "comparative steel sheet(s)") not meeting at least one of the conditions specified in the present invention respectively had disadvantages as follows.

Steel Sheets Nos. 3 and 4 contained Mn in an excessively high content and were susceptible to cementite coarsening. The steel sheets thereby had an elongation EL and a stretch flangeability λ not meeting the acceptance criteria, because cementite remained coarse even after the heat treatment under a recommended condition, and the steel sheets contained fine cementite particles in an insufficient number density.

In contrast, Steel Sheet No. 18 contained Mn in an excessively low content and had a tensile strength TS not meeting the acceptance criterion even after the heat treatment under a recommended condition.

Steel Sheet No. 7 contained Si in an excessively high content, suffered from inferior ductility due to solute strengthening by Si, and had an elongation EL and a stretch flangeability λ not meeting the acceptance criteria.

Steel Sheet No. 25 contained carbon in an excessively high content, had an insufficient ferrite fraction, and was susceptible to cementite coarsening. As a result, the steel sheet had an elongation EL and a stretch flangeability λ not meeting the acceptance criteria, because cementite remained coarse even after the heat treatment under a recommended condition, and the steel sheet contained fine cementite particles in an insufficient number density.

In contrast, Steel Sheet No. 35 contained carbon in an excessively low content, suffered from an excessively high ferrite fraction, and had a tensile strength TS not meeting the acceptance criterion even after the heat treatment under a recommended condition.

Steel Sheet No. 50 underwent annealing at an excessively high ratio of the second heating rate to the first heating rate, underwent no slow cooling, and underwent tempering at an excessively high temperature. The steel sheet thereby contained fine cementite particles in an excessively high number density in ferrite grains because of insufficient dissolution of cementite. The steel sheet had a tensile strength TS not meeting the acceptance criterion, although having an elongation EL and a stretch flangeability λ meeting the acceptance criteria because of undergoing tempering at a high temperature.

Steel Sheet No. 52 underwent annealing at an excessively high ratio of the second heating rate to the first heating rate, and this impeded cementite dissolution. The steel sheet thereby contained fine cementite particles in an excessively high number density in ferrite grains and had a stretch flangeability λ not meeting the acceptance criterion.

Steel Sheet No. 55 underwent annealing at an excessively high annealing temperature, and this caused cementite to be dissolved completely. The steel sheet thereby contained fine cementite particles in an excessively low number density in ferrite grains to increase the hardness of the hard secondary phase excessively and had an elongation EL and a stretch flangeability λ not meeting the acceptance criteria.

Steel Sheet No. 61 underwent slow cooling down to an excessively high end temperature, suffered from an insufficient ferrite fraction, and thereby had an elongation EL and a stretch flangeability λ not meeting the acceptance criteria.

Steel Sheet No. 62 underwent tempering at an excessively low temperature, suffered from excessively high hardness of tempered martensite or the like, and thereby had an elongation EL and a stretch flangeability λ not meeting the acceptance criteria.

In contrast, Steel Sheet No. 64 underwent tempering at an excessively high temperature, suffered from excessively low hardness of tempered martensite or the like, and thereby had a tensile strength TS not meeting the acceptance criterion.

Steel Sheets Nos. 67 to 71 and 72 to 76 underwent slow cooling down to sequentially varied end temperatures so as to have different ferrite fractions. Steel Sheets Nos. 67 to 71 contained fine cementite particles in appropriate number densities in ferrite grains and had properties and variations thereof both meeting the acceptance criteria. In contrast, Steel Sheets Nos. 72 to 76 contained the fine cementite particles in number densities out of the specified range and had variations of the properties not meeting the acceptance criteria, although they had the properties meeting the criteria.

TABLE 5

| | | | Microstructure | | | | | | | | | | | |
|---|---|---|---|---|---|---|---|---|---|---|---|---|---|---|
| | | | Area percentage (%) | | | Number density of θ of 0.05 μm to less than 0.3 μm | Mechanical properties | | | | Variation in mechanical properties | | | |
| Steel sheet number | Steel type | Heat treatment number | α | Hard secondary phase | Other micro-structure | (number per square micrometer) | TS (MPa) | EL (%) | λ (%) | Eval-uation | ΔTS (MPa) | ΔEL (%) | Δ λ (%) | Eval-uation |
| 1 | 1A | 1 | 39 | 61 | 0 | 0.38 | 1032 | 14.6 | 53.2 | ○ | 24 | 0.4 | 3.7 | ○ |
| 2 | | 2 | 37 | 63 | 0 | 0.32 | 1056 | 14.2 | 49.5 | ○ | | | | |
| 3 | 1B | 3 | 37 | 63 | 0 | 0.08 | 1305 | 9.2 | 22.0 | x | 292 | 5.3 | 3.7 | x |
| 4 | | 4 | 43 | 57 | 0 | 0.06 | 1013 | 14.5 | 25.7 | x | | | | |
| 5 | 1C | 5 | 37 | 63 | 0 | 0.36 | 1059 | 14.2 | 50.2 | ○ | 44 | 0.7 | 5.0 | ○ |
| 6 | | 6 | 38 | 62 | 0 | 0.31 | 1015 | 14.9 | 55.2 | ○ | | | | |
| 7 | 1D | 7 | 39 | 61 | 0 | 0.38 | 1289 | 11.7 | 38.5 | x | — | — | — | — |
| 8 | 1E | 8 | 39 | 61 | 0 | 0.37 | 1152 | 14.5 | 62.5 | ○ | 54 | 0.6 | 5.1 | ○ |
| 9 | | 9 | 40 | 60 | 0 | 0.34 | 1098 | 13.9 | 57.4 | ○ | | | | |
| 10 | 1F | 10 | 42 | 58 | 0 | 0.40 | 1014 | 15.1 | 50.3 | ○ | 27 | 0.3 | 1.4 | ○ |
| 11 | | 11 | 40 | 60 | 0 | 0.38 | 1041 | 14.8 | 48.9 | ○ | | | | |
| 12 | 1G | 12 | 42 | 58 | 0 | 0.37 | 1057 | 15.1 | 53.2 | ○ | 58 | 0.5 | 2.5 | ○ |
| 13 | | 13 | 45 | 55 | 0 | 0.36 | 999 | 15.6 | 50.7 | ○ | | | | |
| 14 | 1H | 14 | 39 | 61 | 0 | 0.37 | 1011 | 14.4 | 61.2 | ○ | 38 | 0.4 | 2.5 | ○ |
| 15 | | 15 | 38 | 62 | 0 | 0.35 | 1049 | 14.0 | 58.7 | ○ | | | | |
| 16 | 1I | 16 | 36 | 64 | 0 | 0.41 | 1097 | 14.1 | 48.2 | ○ | 4 | 0.4 | 3.1 | ○ |
| 17 | | 17 | 38 | 62 | 0 | 0.40 | 1101 | 13.7 | 45.1 | ○ | | | | |
| 18 | 1J | 18 | 43 | 57 | 0 | 0.05 | 890 | 15.2 | 47.0 | x | — | — | — | — |
| 19 | 1K | 19 | 40 | 60 | 0 | 0.38 | 1026 | 14.6 | 46.2 | ○ | 69 | 0.7 | 3.9 | ○ |
| 20 | | 20 | 40 | 60 | 0 | 0.37 | 1095 | 13.9 | 42.3 | ○ | | | | |
| 21 | 1L | 21 | 41 | 59 | 0 | 0.37 | 985 | 14.8 | 54.9 | ○ | 1 | 0.1 | 1.9 | ○ |
| 22 | | 22 | 40 | 60 | 0 | 0.36 | 984 | 14.9 | 56.8 | ○ | | | | |
| 23 | 1M | 23 | 39 | 61 | 0 | 0.38 | 1047 | 14.6 | 57.2 | ○ | 35 | 0.4 | 3.1 | ○ |
| 24 | | 24 | 37 | 63 | 0 | 0.35 | 1082 | 14.2 | 54.1 | ○ | | | | |
| 25 | 1N | 25 | 16 | 84 | 0 | 0.12 | 1319 | 10.5 | 26.8 | x | — | — | — | — |
| 26 | 1O | 26 | 40 | 60 | 0 | 0.39 | 1026 | 14.6 | 43.0 | ○ | 59 | 0.7 | 2.6 | ○ |
| 27 | | 27 | 42 | 58 | 0 | 0.31 | 1085 | 13.9 | 40.4 | ○ | | | | |
| 28 | 1P | 28 | 38 | 62 | 0 | 0.37 | 1026 | 14.3 | 57.5 | ○ | 36 | 0.5 | 2.0 | ○ |

TABLE 5-continued

| Steel sheet number | Steel type | Heat treatment number | Microstructure: Area percentage (%) α | Hard secondary phase | Other micro-structure | Number density of θ of 0.05 μm to less than 0.3 μm (number per square micrometer) | Mechanical properties: TS (MPa) | EL (%) | λ (%) | Evaluation | Variation in mechanical properties: ΔTS (MPa) | ΔEL (%) | Δλ (%) | Evaluation |
|---|---|---|---|---|---|---|---|---|---|---|---|---|---|---|
| 29 | | 29 | 41 | 59 | 0 | 0.35 | 1062 | 13.8 | 55.5 | ○ | | | | |
| 30 | 1Q | 30 | 41 | 59 | 0 | 0.37 | 1025 | 14.9 | 49.5 | ○ | 64 | 0.8 | 3.7 | ○ |
| 31 | | 31 | 44 | 56 | 0 | 0.38 | 1089 | 14.1 | 45.8 | ○ | | | | |

(Underlined data: out of the scope of the present invention,
—: unevaluated
α: ferrite
Other microstructures: retained austenite and martensite,
θ: cementite)

TABLE 6

(continued from Table 5)

| Steel sheet number | Steel type | Heat treatment number | Microstructure: Area percentage (%) α | Hard secondary phase | Other micro-structure | Number density of θ of 0.05 μm to less than 0.3 μm (number per square micrometer) | Mechanical properties: TS (MPa) | EL (%) | λ (%) | Evaluation | Variation in mechanical properties: ΔTS (MPa) | ΔEL (%) | Δλ (%) | Evaluation |
|---|---|---|---|---|---|---|---|---|---|---|---|---|---|---|
| 32 | 1R | 32 | 40 | 60 | 0 | 0.36 | 1076 | 14.8 | 49.2 | ○ | — | — | — | — |
| 33 | 1S | 33 | 38 | 62 | 0 | 0.40 | 1016 | 14.3 | 48.3 | ○ | — | — | — | — |
| 34 | 1T | 34 | 38 | 62 | 0 | 0.41 | 1088 | 14.3 | 41.6 | ○ | — | — | — | — |
| 35 | 1U | 35 | 93 | 7 | 0 | 0.36 | 712 | 24.4 | 87.1 | x | — | — | — | — |
| 36 | 1V | 36 | 38 | 62 | 0 | 0.42 | 1006 | 14.3 | 41.3 | ○ | — | — | — | — |
| 37 | 1W | 37 | 41 | 59 | 0 | 0.41 | 1010 | 14.9 | 53.3 | ○ | — | — | — | — |
| 38 | 1X | 38 | 42 | 58 | 0 | 0.42 | 1072 | 15.0 | 50.3 | ○ | — | — | — | — |
| 39 | 1Y | 39 | 43 | 57 | 0 | 0.38 | 1061 | 15.3 | 50.5 | ○ | — | — | — | — |
| 40 | 1Z | 40 | 38 | 62 | 0 | 0.43 | 1068 | 14.5 | 50.6 | ○ | — | — | — | — |
| 41 | 2A | 41 | 36 | 64 | 0 | 0.36 | 1043 | 14.1 | 57.9 | ○ | — | — | — | — |
| 42 | 2B | 42 | 39 | 61 | 0 | 0.40 | 1047 | 14.6 | 52.7 | ○ | — | — | — | — |
| 43 | 2C | 43 | 39 | 61 | 0 | 0.43 | 1006 | 14.6 | 46.6 | ○ | — | — | — | — |
| 44 | 2D | 44 | 40 | 60 | 0 | 0.39 | 1056 | 14.8 | 63.5 | ○ | — | — | — | — |
| 45 | 2E | 45 | 36 | 64 | 0 | 0.37 | 1081 | 13.9 | 64.2 | ○ | — | — | — | — |
| 46 | 2F | 46 | 40 | 60 | 0 | 0.38 | 1051 | 14.6 | 55.7 | ○ | — | — | — | — |

(Underlined data: out of the scope of the present invention,
—: unevaluated,
α: ferrite
Other microstructures: retained austenite and martensite,
θ: cementite)

TABLE 7

(continued from Table 6)

| Steel sheet number | Steel type | Heat treatment number | Microstructure: Area percentage (%) α | Hard secondary phase | Other micro-structure | Number density of θ of 0.05 μm to less than 0.3 μm (number per square micrometer) | Mechanical properties: TS (MPa) | EL (%) | λ (%) | Evaluation | Variation in mechanical properties: ΔTS (MPa) | ΔEL (%) | Δλ (%) | Evaluation |
|---|---|---|---|---|---|---|---|---|---|---|---|---|---|---|
| 47 | 2G | 47 | 39 | 61 | 0 | 0.32 | 1072 | 14.6 | 59.1 | ○ | — | — | — | — |
| 48 | | 48 | 36 | 64 | 0 | 0.18 | 1049 | 14.8 | 52.9 | ○ | — | — | — | — |
| 49 | | 49 | 38 | 62 | 0 | 0.36 | 1081 | 14.0 | 65.6 | ○ | — | — | — | — |

TABLE 7-continued (continued from Table 6)

| Steel sheet number | Steel type | Heat treatment number | Microstructure: Area percentage (%) α | Hard secondary phase | Other micro-structure | Number density of θ of 0.05 μm to less than 0.3 μm (number per square micrometer) | Mechanical properties: TS (MPa) | EL (%) | λ (%) | Eval-uation | Variation in mechanical properties: ΔTS (MPa) | ΔEL (%) | Δ λ (%) | Eval-uation |
|---|---|---|---|---|---|---|---|---|---|---|---|---|---|---|
| 50 | | 50 | 28 | 72 | 0 | 0.55 | 962 | 14.1 | 54.2 | x | — | — | — | — |
| 51 | | 51 | 42 | 58 | 0 | 0.09 | 1095 | 14.1 | 56.5 | ○ | — | — | — | — |
| 52 | | 52 | 38 | 62 | 0 | 0.54 | 1043 | 13.1 | 21.5 | x | — | — | — | — |
| 53 | | 53 | 40 | 60 | 0 | 0.38 | 1066 | 14.7 | 45.8 | ○ | — | — | — | — |
| 54 | | 54 | 43 | 57 | 0 | 0.29 | 1057 | 15.3 | 41.5 | ○ | — | — | — | — |
| 55 | | 55 | 42 | 58 | 0 | 0.00 | 1295 | 9.9 | 36.1 | x | — | — | — | — |
| 56 | | 56 | 38 | 62 | 0 | 0.38 | 1068 | 14.4 | 41.8 | ○ | — | — | — | — |
| 57 | | 57 | 41 | 59 | 0 | 0.36 | 1075 | 14.1 | 67.2 | ○ | — | — | — | — |
| 58 | | 58 | 38 | 62 | 0 | 0.40 | 1053 | 15.1 | 52.3 | ○ | — | — | — | — |
| 59 | | 59 | 43 | 57 | 0 | 0.39 | 1101 | 14.0 | 51.7 | ○ | — | — | — | — |
| 60 | | 60 | 48 | 52 | 0 | 0.39 | 1009 | 16.3 | 54.5 | ○ | — | — | — | — |
| 61 | | 61 | 18 | 82 | 0 | 0.37 | 1215 | 10.7 | 28.4 | x | — | — | — | — |
| 62 | | 62 | 42 | 58 | 0 | 0.42 | 1263 | 9.0 | 35.5 | x | — | — | — | — |
| 63 | | 63 | 39 | 61 | 0 | 0.38 | 1037 | 13.2 | 43.1 | ○ | — | — | — | — |
| 64 | | 64 | 41 | 59 | 0 | 0.41 | 922 | 17.2 | 56.5 | x | — | — | — | — |
| 65 | | 65 | 37 | 63 | 0 | 0.39 | 1047 | 15.2 | 49.7 | ○ | — | — | — | — |
| 66 | | 66 | 42 | 58 | 0 | 0.42 | 1075 | 14.1 | 43.8 | ○ | — | — | — | — |
| 67 | | 67 | 22 | 78 | 0 | 0.38 | 1082 | 14.2 | 52.4 | ○ | 63 | 0.8 | 3.3 | ○ |
| 68 | | 68 | 28 | 72 | 0 | 0.38 | 1069 | 13.8 | 53.0 | ○ | | | | |
| 69 | | 69 | 36 | 64 | 0 | 0.38 | 1054 | 14.5 | 51.5 | ○ | | | | |
| 70 | | 70 | 40 | 60 | 0 | 0.38 | 1035 | 14.2 | 52.9 | ○ | | | | |
| 71 | | 71 | 42 | 58 | 0 | 0.38 | 1019 | 14.6 | 54.8 | ○ | | | | |
| 72 | | 72 | 21 | 79 | 0 | 0.00 | 1265 | 13.1 | 70.5 | ○ | 254 | 2.0 | 29.3 | x |
| 73 | | 73 | 27 | 73 | 0 | 0.00 | 1201 | 13.4 | 63.4 | ○ | | | | |
| 74 | | 74 | 34 | 66 | 0 | 0.00 | 1159 | 13.2 | 55.7 | ○ | | | | |
| 75 | | 75 | 39 | 61 | 0 | 0.00 | 1082 | 14.8 | 46.2 | ○ | | | | |
| 76 | | 76 | 44 | 56 | 0 | 0.00 | 1011 | 15.2 | 41.2 | ○ | | | | |

(Underlined data: out of the scope of the present invention
—: unevaluated,
α: ferrite
Other microstructures: retained austenite and martensite,
θ: cementite)

Second Experimental Example

Experimental Example on Microstructure Condition (b) and Second Annealing Condition Ingots having a thickness of 120 mm were made from molten steels having different chemical compositions given in Table 8 below. The ingots were hot-rolled to a thickness of 25 mm, and hot-rolled again to a thickness of 3.2 mm at a finish rolling end temperature of 900° C. to 1000° C. and a coiling temperature of 450° C. to 600° C. The works were acid-washed, cold-rolled to a thickness of 1.6 mm, and yielded cold-rolled steel sheets as test samples. The test samples were subjected to heat treatments under conditions given in Tables 9 to 11 (see the heat treatment pattern in FIG. 1).

Ac1 and Ac3 in Table 8 were determined according to Expressions 1 and 2 as follows (see "The Physical Metallurgy of Steels", William C. Leslie (Japanese translation, translated under the supervision of Kouda Shigeyasu, p. 273 (1985), Maruzen Co., Ltd.).

$$Ac1\ (°\ C.)=723+29.1\ [Si]-10.7[Mn]+16.9[Cr]-16.9[Ni] \quad \text{Expression 1}$$

$$Ac3(°\ C.)=910-203\sqrt{[C]}+44.7[Si]+31.5[Mo]-15.2[Ni] \quad \text{Expression 2}$$

where [X] represents a content (in mass percent) of each element.

TABLE 8

| Steel type | Chemical composition (in mass percent) [with the remainder including Fe and inevitable impurities] C | Si | Mn | P | S | Al | N | Other element | Ac1 (° C.) | Ac3 (° C.) | (Ac1 + Ac3)/2 (° C.) |
|---|---|---|---|---|---|---|---|---|---|---|---|
| 1A | 0.17 | 1.19 | 1.81 | 0.001 | 0.001 | 0.042 | 0.0045 | Li: 0.0019 | 738 | 879 | 809 |
| 1B | 0.18 | 1.37 | 1.60 | 0.001 | 0.003 | 0.047 | 0.0032 | Ca: 0.0002, Li: 0.0010 | 746 | 885 | 815 |
| 1C | 0.12 | 1.26 | 3.45 | 0.003 | 0004 | 0.037 | 0.0052 | Ca: 0.0012 | 723 | 896 | 809 |
| 1D | 0.15 | 1.42 | 1.48 | 0.002 | 0.018 | 0.035 | 0.0039 | Ca: 0.0009 | 748 | 895 | 822 |
| 1E | 0.16 | 1.26 | 1.42 | 0.002 | 0.003 | 0.039 | 0.0043 | Ca: 0.0005, Mg: 0.0006 | 744 | 885 | 815 |
| 1F | 0.16 | 1.20 | 2.12 | 0.014 | 0.001 | 0.039 | 0.0043 | Mg: 0.0013 | 735 | 882 | 809 |
| 1G | 0.17 | 1.29 | 1.97 | 0.003 | 0.004 | 0.034 | 0.0042 | — | 739 | 884 | 812 |

TABLE 8-continued

| Steel type | Chemical composition (in mass percent) [with the remainder including Fe and inevitable impurities] C | Si | Mn | P | S | Al | N | Other element | Ac1 (° C.) | Ac3 (° C.) | (Ac1 + Ac3)/2 (° C.) |
|---|---|---|---|---|---|---|---|---|---|---|---|
| 1H | 0.12 | 1.20 | 5.31 | 0.001 | 0.002 | 0.041 | 0.0042 | — | 701 | 893 | 797 |
| 1I | 0.18 | 1.43 | 1.87 | 0.002 | 0.005 | 0.035 | 0.0048 | Cr: 0.28, Ca: 0.0011 | 749 | 888 | 819 |
| 1J | 0.13 | 1.27 | 2.18 | 0.003 | 0.001 | 0.040 | 0.0045 | Mo: 0.15 | 737 | 898 | 817 |
| 1K | 0.14 | 1.23 | 0.03 | 0.001 | 0.002 | 0.046 | 0.0037 | Ca: 0.0005 | 758 | 889 | 824 |
| 1L | 0.15 | 1.22 | 1.54 | 0.003 | 0.004 | 0.044 | 0.0044 | Ni: 0.06 | 741 | 885 | 813 |
| 1M | 0.15 | 1.27 | 1.57 | 0.002 | 0.004 | 0.032 | 0.0041 | Ca: 0.0005 | 743 | 888 | 816 |
| 1N | 0.23 | 1.19 | 1.61 | 0.002 | 0.005 | 0.043 | 0.0048 | Ca: 0.0006 | 740 | 866 | 803 |
| 1O | 0.17 | 1.30 | 2.07 | 0.023 | 0.001 | 0.033 | 0.0054 | — | 739 | 884 | 812 |
| 1P | 0.19 | 1.33 | 1.57 | 0.003 | 0.002 | 0.047 | 0.0049 | REM: 0.0007 | 745 | 881 | 813 |
| 1Q | 0.13 | 1.32 | 1.84 | 0.002 | 0.002 | 0.032 | 0.0041 | — | 742 | 896 | 819 |
| 1R | 0.35 | 1.37 | 1.83 | 0.001 | 0.003 | 0.038 | 0.0046 | Ca: 0.0009 | 743 | 851 | 797 |
| 1S | 0.14 | 1.31 | 2.09 | 0.003 | 0.010 | 0.039 | 0.0054 | — | 739 | 893 | 816 |
| 1T | 0.17 | 1.31 | 1.61 | 0.003 | 0.005 | 0.037 | 0.0033 | Cu: 0.08, Ca: 0.0008 | 744 | 885 | 814 |
| 1U | 0.16 | 1.23 | 1.17 | 0.002 | 0.005 | 0.043 | 0.0041 | — | 746 | 884 | 815 |
| 1V | 0.13 | 1.40 | 1.92 | 0.001 | 0.004 | 0.036 | 0.0030 | Ni: 0.32, Ca: 0.0006 | 738 | 895 | 816 |
| 1W | 0.18 | 3.22 | 1.42 | 0.002 | 0.002 | 0.031 | 0.0043 | Ca: 0.0010 | 802 | 968 | 885 |
| 1X | 0.13 | 1.29 | 1.86 | 0.002 | 0.001 | 0.044 | 0.0049 | Ca: 0.0007, Mg: 0.0006 | 741 | 894 | 818 |
| 1Y | 0.12 | 0.16 | 1.52 | 0.003 | 0.005 | 0.046 | 00032 | Ca: 0.0012 | 711 | 847 | 779 |
| 1Z | 0.17 | 1.28 | 2.14 | 0.008 | 0.002 | 0.043 | 0.0032 | Ca: 0.0007 | 737 | 884 | 810 |
| 2A | 0.15 | 1.17 | 1.84 | 0.001 | 0.001 | 0.037 | 0.0039 | Cu: 0.45 | 737 | 884 | 811 |
| 2B | 0.17 | 2.07 | 1.80 | 0.003 | 0.001 | 0.037 | 0.0041 | — | 764 | 919 | 841 |
| 2C | 0.14 | 1.16 | 1.37 | 0.002 | 0.004 | 0.039 | 0.0027 | Li: 0.0006 | 742 | 886 | 814 |
| 2D | 0.03 | 1.26 | 2.13 | 0.003 | 0.002 | 0.044 | 0.0028 | — | 737 | 931 | 834 |
| 2E | 0.13 | 1.35 | 1.60 | 0.002 | 0.001 | 0.032 | 0.0036 | Mo: 0.04, Ca: 0.0013 | 745 | 898 | 822 |
| 2F | 0.18 | 1.28 | 1.50 | 0.001 | 0.004 | 0.036 | 0.0029 | Cr: 0.05, Ca: 0.0007 | 745 | 881 | 813 |
| 2G | 0.16 | 1.22 | 1.80 | 0.003 | 0.004 | 0.046 | 0.0049 | Ca: 0.0008, REM: 0.0011 | 739 | 883 | 811 |

(Underlined data: out of the scope of the present invention, —: less than detection limit)

TABLE 9

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 1 | 1A | 4.8 | 2.2 | 0.46 | 850 | 120 | 10 | 650 | 50 | 60 | 450 | 300 |
| 2 | | 3.4 | 1.5 | 0.44 | 850 | 120 | 10 | 650 | 50 | 60 | 450 | 300 |
| 3 | 1B | 4.8 | 2.2 | 0.46 | 850 | 120 | 10 | 600 | 50 | 60 | 425 | 300 |
| 4 | | 4.8 | 1.5 | 0.31 | 850 | 120 | 10 | 600 | 50 | 60 | 425 | 300 |
| 5 | 1C | 4.8 | 2.2 | 0.46 | 825 | 120 | 10 | 650 | 50 | 60 | 450 | 300 |
| 6 | | 4.8 | 2.2 | 0.46 | 835 | 120 | 10 | 650 | 50 | 60 | 450 | 300 |
| 7 | 1D | 4.8 | 2.2 | 0.46 | 850 | 120 | 10 | 600 | 50 | 60 | 450 | 300 |
| 8 | | 4.8 | 2.2 | 0.46 | 850 | 100 | 10 | 600 | 50 | 60 | 450 | 300 |
| 9 | 1E | 4.8 | 2.2 | 0.46 | 825 | 120 | 10 | 600 | 50 | 60 | 450 | 300 |
| 10 | | 4.8 | 2.2 | 0.46 | 825 | 120 | 15 | 600 | 50 | 60 | 450 | 300 |
| 11 | 1F | 4.8 | 2.2 | 0.46 | 850 | 120 | 10 | 600 | 50 | 60 | 425 | 300 |
| 12 | | 4.8 | 2.2 | 0.46 | 850 | 120 | 10 | 625 | 50 | 60 | 425 | 300 |

(Underlined data: out of the scope of the present invention)

TABLE 10

(continued from Table 9)

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 13 | 1G | 0.3 | 0.2 | 0.67 | 825 | 120 | 10 | 600 | 50 | 60 | 450 | 300 |
| 14 | | 0.6 | 0.2 | 0.33 | 825 | 120 | 10 | 600 | 50 | 60 | 450 | 300 |

TABLE 10-continued (continued from Table 9)

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 15 | | 2.4 | 1.1 | 0.46 | 850 | 120 | 10 | 650 | 50 | 60 | 450 | 300 |
| 16 | | 4.8 | 1.0 | 0.21 | 850 | 120 | 10 | 650 | 50 | 60 | 450 | 300 |
| 17 | | 1.0 | 1.0 | 1.00 | 820 | 120 | — | 820 | 100 | 60 | 515 | 300 |
| 18 | | 4.8 | 2.0 | 0.42 | 850 | 120 | 10 | 600 | 50 | 60 | 450 | 300 |
| 19 | | 4.8 | 3.0 | 0.63 | 850 | 120 | 10 | 650 | 50 | 60 | 450 | 300 |
| 20 | | 2.5 | 2.5 | 1.00 | 850 | 120 | 10 | 600 | 50 | 60 | 450 | 300 |
| 21 | | 4.8 | 2.2 | 0.46 | 800 | 120 | 10 | 650 | 50 | 60 | 450 | 300 |
| 22 | | 4.8 | 2.2 | 0.46 | 825 | 120 | 10 | 600 | 50 | 60 | 450 | 300 |
| 23 | | 4.8 | 2.2 | 0.46 | 875 | 120 | 10 | 650 | 50 | 60 | 450 | 300 |
| 24 | | 4.8 | 2.2 | 0.46 | 900 | 120 | 10 | 600 | 50 | 60 | 450 | 300 |
| 25 | | 4.8 | 2.2 | 0.46 | 850 | 90 | 10 | 650 | 50 | 60 | 450 | 300 |
| 26 | | 4.8 | 2.2 | 0.46 | 850 | 180 | 10 | 600 | 50 | 60 | 450 | 300 |
| 27 | | 4.8 | 2.2 | 0.46 | 825 | 120 | 5 | 650 | 50 | 60 | 450 | 300 |
| 28 | | 4.8 | 2.2 | 0.46 | 850 | 120 | 20 | 600 | 50 | 60 | 450 | 300 |
| 29 | | 4.8 | 2.2 | 0.46 | 850 | 120 | 10 | 550 | 50 | 60 | 450 | 300 |
| 30 | | 4.8 | 2.2 | 0.46 | 850 | 120 | 10 | 750 | 50 | 60 | 450 | 300 |
| 31 | | 4.8 | 2.2 | 0.46 | 825 | 120 | 10 | 600 | 50 | 60 | 250 | 300 |
| 32 | | 4.8 | 2.2 | 0.46 | 850 | 120 | 10 | 650 | 50 | 60 | 350 | 300 |
| 33 | | 4.8 | 2.2 | 0.46 | 825 | 120 | 10 | 600 | 50 | 60 | 550 | 300 |
| 34 | | 4.8 | 2.2 | 0.46 | 850 | 120 | 10 | 650 | 50 | 60 | 450 | 200 |
| 35 | | 4.8 | 2.2 | 0.46 | 825 | 120 | 10 | 600 | 50 | 60 | 450 | 400 |
| 36 | | 4.8 | 2.2 | 0.46 | 850 | 120 | 10 | 700 | 50 | 60 | 425 | 300 |
| 37 | | 4.8 | 2.2 | 0.46 | 850 | 120 | 10 | 675 | 50 | 60 | 425 | 300 |
| 38 | | 4.8 | 2.2 | 0.46 | 850 | 120 | 10 | 650 | 50 | 60 | 425 | 300 |
| 39 | | 4.8 | 2.2 | 0.46 | 850 | 120 | 10 | 625 | 50 | 60 | 425 | 300 |
| 40 | | 4.8 | 2.2 | 0.46 | 850 | 120 | 10 | 600 | 50 | 60 | 425 | 300 |
| 41 | | 7.2 | 2.8 | 0.39 | 850 | 120 | 10 | 700 | 50 | 60 | 425 | 300 |
| 42 | | 7.2 | 2.8 | 0.39 | 850 | 120 | 10 | 675 | 50 | 60 | 425 | 300 |
| 43 | | 7.2 | 2.8 | 0.39 | 850 | 120 | 10 | 650 | 50 | 60 | 425 | 300 |
| 44 | | 7.2 | 2.8 | 0.39 | 850 | 120 | 10 | 625 | 50 | 60 | 425 | 300 |
| 45 | | 7.2 | 2.8 | 0.39 | 850 | 120 | 10 | 600 | 50 | 60 | 425 | 300 |

(Underlined data: out of the scope of the present invention)

TABLE 11

(continued form Table 10)

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 46 | 1H | 4.8 | 2.2 | 0.46 | 825 | 120 | 10 | 650 | 50 | 60 | 450 | 300 |
| 47 | | 4.8 | 2.2 | 0.46 | 825 | 120 | 10 | 600 | 50 | 60 | 450 | 300 |
| 48 | 1I | 4.8 | 2.2 | 0.46 | 825 | 120 | 10 | 650 | 50 | 60 | 425 | 300 |
| 49 | | 4.8 | 2.2 | 0.46 | 825 | 120 | 10 | 650 | 75 | 60 | 425 | 300 |
| 50 | 1J | 4.8 | 2.2 | 0.46 | 850 | 120 | 10 | 650 | 50 | 60 | 450 | 300 |
| 51 | | 4.8 | 2.2 | 0.46 | 850 | 120 | 10 | 650 | 50 | 40 | 450 | 300 |
| 52 | 1K | 4.8 | 2.2 | 0.46 | 825 | 120 | 10 | 650 | 50 | 60 | 400 | 300 |
| 53 | 1L | 4.8 | 2.2 | 0.46 | 850 | 120 | 10 | 600 | 50 | 60 | 450 | 300 |
| 54 | | 4.8 | 2.2 | 0.46 | 850 | 120 | 10 | 600 | 50 | 60 | 425 | 300 |
| 55 | 1M | 4.8 | 2.2 | 0.46 | 825 | 120 | 10 | 650 | 50 | 60 | 450 | 300 |
| 56 | | 4.8 | 2.2 | 0.46 | 825 | 120 | 10 | 650 | 50 | 60 | 450 | 200 |
| 57 | 1N | 4.8 | 2.2 | 0.46 | 850 | 120 | 10 | 600 | 50 | 60 | 400 | 300 |
| 58 | | 4.8 | 1.9 | 0.44 | 825 | 120 | 10 | 600 | 50 | 60 | 400 | 300 |
| 59 | 1O | 4.8 | 2.2 | 0.46 | 850 | 120 | 10 | 650 | 50 | 60 | 425 | 300 |
| 60 | | 4.8 | 2.2 | 0.46 | 835 | 120 | 10 | 625 | 50 | 60 | 425 | 300 |
| 61 | 1P | 48 | 2.2 | 0.46 | 825 | 120 | 10 | 600 | 50 | 60 | 450 | 300 |

TABLE 11-continued (continued form Table 10)

| Heat treatment number | Steel type | Annealing condition: First heating rate HR1 (° C./s) | Second heating rate HR2 (° C./s) | HR2/HR1 (–) | Annealing temperature (° C.) | Annealing holding time (s) | Slow cooling rate (° C./s) | Slow cooling end temperature (° C.) | Rapid cooling rate (° C./s) | Rapid cooling end temperature (° C.) | Tempering condition: Tempering temperature (° C.) | Tempering holding time (s) |
|---|---|---|---|---|---|---|---|---|---|---|---|---|
| 62 | | 4.8 | 2.2 | 0.46 | 850 | 120 | 10 | 600 | 50 | 60 | 425 | 300 |
| 63 | 1Q | 4.8 | 2.2 | 0.46 | 850 | 120 | 10 | 650 | 50 | 60 | 450 | 300 |
| 64 | | 4.8 | 2.2 | 0.46 | 825 | 120 | 10 | 650 | 50 | 60 | 425 | 300 |
| 65 | 1R | 4.8 | 2.2 | 0.46 | 825 | 120 | 10 | 600 | 50 | 60 | 450 | 300 |
| 66 | 1S | 4.8 | 2.2 | 0.46 | 850 | 120 | 10 | 650 | 50 | 60 | 450 | 300 |
| 67 | 1T | 4.8 | 2.2 | 0.46 | 850 | 120 | 10 | 600 | 50 | 60 | 400 | 300 |
| 68 | 1U | 4.8 | 2.2 | 0.46 | 825 | 120 | 10 | 600 | 50 | 60 | 450 | 300 |
| 69 | 1V | 4.8 | 2.2 | 0.46 | 850 | 120 | 10 | 600 | 50 | 60 | 450 | 300 |
| 70 | 1W | 4.8 | 2.2 | 0.46 | 900 | 120 | 10 | 650 | 50 | 60 | 425 | 300 |
| 71 | 1X | 4.8 | 2.2 | 0.46 | 825 | 120 | 10 | 600 | 50 | 60 | 450 | 300 |
| 72 | 1Y | 4.8 | 2.2 | 0.46 | 850 | 120 | 10 | 600 | 50 | 60 | 450 | 300 |
| 73 | 1Z | 4.8 | 2.2 | 0.46 | 825 | 120 | 10 | 650 | 50 | 60 | 450 | 300 |
| 74 | 2A | 4.8 | 2.2 | 0.46 | 825 | 120 | 10 | 600 | 50 | 60 | 450 | 300 |
| 75 | 2B | 4.8 | 2.2 | 0.46 | 850 | 120 | 10 | 600 | 50 | 60 | 450 | 300 |
| 76 | 2C | 4.8 | 2.2 | 0.46 | 850 | 120 | 10 | 650 | 50 | 60 | 450 | 300 |
| 77 | 2D | 4.8 | 2.2 | 0.46 | 850 | 120 | 10 | 600 | 50 | 60 | 450 | 300 |
| 78 | 2E | 4.8 | 2.2 | 0.46 | 825 | 120 | 10 | 600 | 50 | 60 | 425 | 300 |
| 79 | 2F | 4.8 | 2.2 | 0.46 | 850 | 120 | 10 | 650 | 50 | 60 | 450 | 300 |
| 80 | 2G | 4.8 | 2.2 | 0.46 | 850 | 120 | 10 | 600 | 50 | 60 | 450 | 300 |

(Underlined data: out of the scope of the present invention)

The area percentages of respective phases, and the sizes and the number densities of cementite particles were measured on the respective steel sheets after the heat treatments by the measuring methods as described above.

The tensile strength TS, elongation EL, and stretch flangeability λ were measured on the respective steel sheets after the heat treatments to evaluate the properties of the steel sheets. In addition, how much the properties varied depending on the change of the heat treatment conditions was determined to evaluate the stability of the properties of the respective steel sheets.

Specifically, the properties of the steel sheets after the heat treatments were evaluated in a manner as follows. Samples meeting all the conditions, i.e., a tensile strength TS of 980 MPa or more, an elongation EL of 13% or more, and a stretch flangeability λ of 40% or more, were evaluated as accepted (having acceptable properties) (○); and the other samples were evaluated as rejected (x).

The property stability of the respective steel sheets after heat treatments was evaluated by performing heat treatments on test samples of the same steel type while varying the heat treatment condition within a maximum fluctuation range of heat treatment condition of actual equipment. Samples meeting all the conditions: a ΔTS of 200 MPa or less, a ΔEL of 2% or less, and a Δλ of 20% or less, were evaluated as accepted (having acceptable stability in the properties) (○); and the other samples were evaluated as rejected (x), where the ΔTS, ΔEL, and Δλ are variation widths of TS, EL, and λ, respectively.

The tensile strength TS and elongation EL were measured by preparing a No. 5 test specimen prescribed in JIS Z 2201 with its long axis in a direction perpendicular to the rolling direction; and subjecting the test specimen to measurements according to JIS Z 2241. The stretch flangeability λ was determined by performing a bore expanding test according to The Japan Iron and Steel Federation Standard (JFS) T1001 to measure a bore expansion ratio; and defining this as the stretch flangeability.

Measurement results are indicated in Tables 12 to 14.

The tables demonstrate that Steel Sheets Nos. 1 to 12, 36 to 40, 48 to 51, and 53 to 64 were steel sheets according to the embodiments of the present invention meeting all conditions specified in the present invention. The tables also demonstrate that all the steel sheets according to the embodiments of the present invention were homogeneous cold-rolled steel sheets not only having excellent absolute values of the mechanical properties, but also having smaller variations in mechanical properties.

Steel Sheets Nos. 14 to 16, 18, 22, 23, 25 to 29, 32, 34, 35, 66 to 69, 71 to 76, and 78 to 80 also met all the conditions specified in the present invention. The steel sheets were verified to have excellent absolute values of the mechanical properties, but their variations in mechanical properties were not yet evaluated. It is analogized, however, that the steel sheets also have variations in mechanical properties at acceptable levels as with the steel sheets according to the embodiments of the present invention.

In contrast, comparative steel sheets not meeting at least one of the conditions specified in the present invention had disadvantages as follows.

Steel Sheet No. 13 underwent annealing at an excessively low first heating rate, thereby caused cementite to be coarsened, contained residual coarse cementite particles in an excessively high number density in ferrite grains, and had an elongation EL and a stretch flangeability λ not meeting the acceptance criteria.

Steel Sheet No. 17 underwent annealing at an excessively high ratio of the second heating rate to the first heating rate, underwent no slow cooling, and underwent tempering at an excessively high temperature. The steel sheet contained coarse cementite particles in an excessively high number density in ferrite grains because cementite was dissolved insufficiently and remained as coarse. The steel sheet had a tensile strength TS not meeting the acceptance criterion, although having an elongation EL and a stretch flangeability λ meeting the acceptance criteria because of undergoing tempering at a high temperature.

Steel Sheets Nos. 19 and 20 underwent annealing at an excessively high ratio of the second heating rate to the first heating rate, and this caused cementite not to be dissolved but to remain coarse. The steel sheet contained coarse cementite particles in an excessively high number density in ferrite grains and thereby had a stretch flangeability λ not meeting the acceptance criterion.

Steel Sheet No. 21 underwent annealing at an excessively low annealing temperature, and this caused cementite not to be dissolved, but to remain coarse. The steel sheet thereby contained coarse cementite particles in an excessively high number density in ferrite grains and had a stretch flangeability λ not meeting the acceptance criterion.

Steel Sheet No. 24 underwent annealing at an excessively high annealing temperature, and this caused cementite to be dissolved completely. The steel sheet thereby contained coarse cementite particles in an excessively low number density in ferrite grains, contained the hard secondary phase having excessively high hardness, and had an elongation EL not meeting the acceptance criterion.

Steel Sheet No. 30 underwent slow cooling to an excessively high end temperature, suffered from an insufficient ferrite fraction, and thereby had an elongation EL and a stretch flangeability λ not meeting the acceptance criteria.

Steel Sheet No. 31 underwent tempering at an excessively low temperature, suffered from excessively high hardness of tempered martensite or the like, and thereby had an elongation EL and a stretch flangeability λ not meeting the acceptance criteria.

In contrast, Steel Sheet No. 33 underwent tempering at an excessively high temperature, suffered from excessively low hardness of tempered martensite or the like, and thereby had a tensile strength TS not meeting the acceptance criterion.

Steel Sheets Nos. 36 to 40 and 41 to 45 underwent slow cooling down to sequentially varied end temperatures so as to have different ferrite fractions. Steel Sheets Nos. 36 to 40 contained coarse cementite particles in appropriate number densities in ferrite grains and had both properties and variations thereof meeting the acceptance criteria.

In contrast, Steel Sheets Nos. 41 to 45 contained the coarse cementite particles in number densities out of the specified range and had variations in the properties not meeting the acceptance criteria, although they had the properties meeting the acceptance criteria.

Steel Sheets Nos. 46 and 47 contained Mn in an excessively high content, and this caused cementite to be susceptible to coarsening and to remain coarse even after the heat treatment under a recommended condition. The steel sheet thereby had an elongation EL and a stretch flangeability λ not meeting the acceptance criteria.

In contrast, Steel Sheet No. 52 contained Mn in an excessively low content and thereby had a tensile strength TS not meeting the acceptance criterion even after the heat treatment under a recommended condition.

Steel Sheet No. 65 contained carbon in an excessively high content. This caused an insufficient ferrite fraction and caused cementite to be susceptible to coarsening and to remain coarse even after the heat treatment under a recommended condition. The steel sheet thereby had an elongation EL and a stretch flangeability λ not meeting the acceptance criteria.

In contrast, Steel Sheet No. 77 contained carbon in an excessively low content, had an excessively high ferrite fraction, and had a tensile strength TS not meeting the acceptance criterion even after the heat treatment under a recommended condition.

Steel Sheet No. 70 contained Si in an excessively high content, had inferior ductility due to solute strengthening by Si, and thereby had an elongation EL and a stretch flangeability λ not meeting the acceptance criteria.

Figure 2:
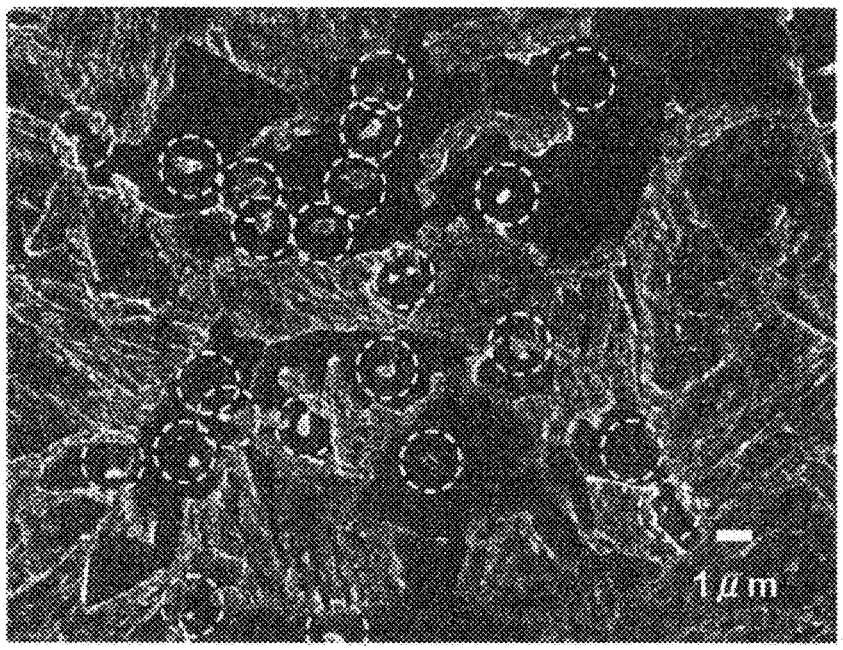
FIG. 2 depicts cross-sectional photographs of microstructures of a steel sheet according to the embodiment of the present invention and a comparative steel sheet in Second Experimental Example.
Figure 2:
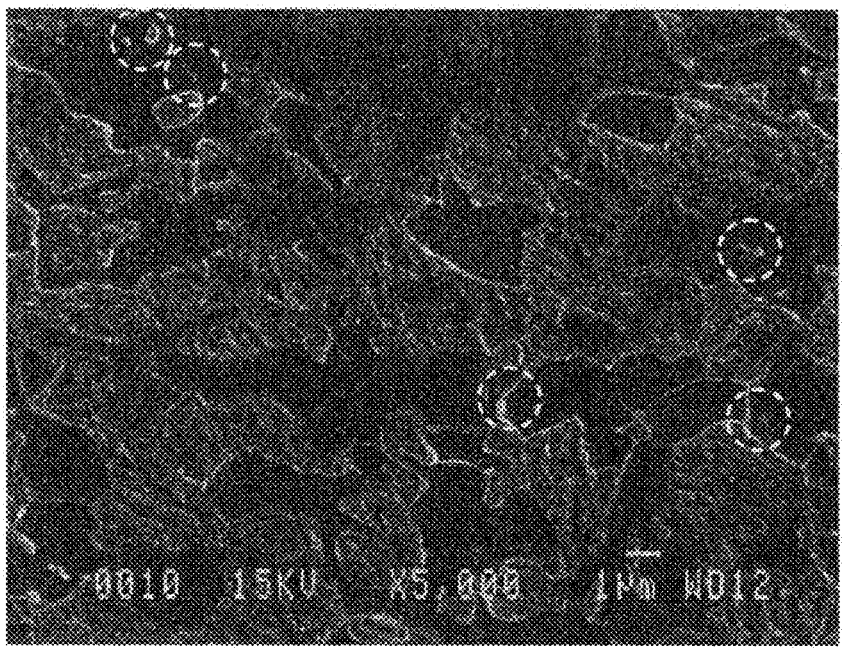

In this connection, FIG. 2 illustrates how cementite particles are distributed in ferrite grains on the steel sheet according to the embodiment of the present invention (Steel Sheet No. 38) and the comparative steel sheet (Steel Sheet No. 43). FIG. 2 is obtained by SEM observation, in which blackish solid regions are identified as ferrite grains; and white areas (each surrounded by a dashed circle) present in ferrite grains are identified as cementite particles. FIG. 2 demonstrates that the steel sheet according to the embodiment of the present invention contained relatively large cementite particles in a larger number density in ferrite grains than that of the comparative steel sheet.

TABLE 12

| | | | Microstructure | | | | | | | | | | | |
|---|---|---|---|---|---|---|---|---|---|---|---|---|---|---|
| | | | Area percentage (%) | | | Number density of θ of 0.3 μm or more | | | | | Variation | | | |
| Steel | | Heat | | Hard | Other | (number per | Mechanical properties | | | | in mechanical properties | | | |
| sheet number | Steel type | treatment number | α | secondary phase | micro-structure | square micrometer) | TS (MPa) | EL (%) | λ (%) | Eval-uation | ΔTS (MPa) | ΔEL (%) | Δ λ (%) | Eval-uation |
| 1 | 1A | 1 | 40 | 60 | 0 | 0.08 | 1066 | 14.7 | 63.4 | ○ | 21 | 0.8 | 1.3 | ○ |
| 2 | | 2 | 41 | 59 | 0 | 0.10 | 1045 | 13.9 | 62.1 | ○ | | | | |
| 3 | 1B | 3 | 43 | 57 | 0 | 0.08 | 1061 | 15.3 | 51.4 | ○ | 6 | 0.5 | 2.2 | ○ |
| 4 | | 4 | 38 | 62 | 0 | 0.07 | 1067 | 15.8 | 49.2 | ○ | | | | |
| 5 | 1C | 5 | 39 | 61 | 0 | 0.12 | 996 | 14.5 | 47.5 | ○ | 71 | 0.4 | 2.7 | ○ |
| 6 | | 8 | 40 | 60 | 0 | 0.11 | 1013 | 14.1 | 50.2 | ○ | | | | |
| 7 | 1D | 7 | 40 | 60 | 0 | 0.07 | 1036 | 14.7 | 47.1 | ○ | 24 | 0.3 | 3.1 | ○ |
| 8 | | 8 | 39 | 61 | 0 | 0.08 | 1012 | 15.0 | 50.2 | ○ | | | | |
| 9 | 1E | 9 | 39 | 61 | 0 | 0.07 | 1057 | 14.5 | 56.1 | ○ | 24 | 0.6 | 1.1 | ○ |
| 10 | | 10 | 38 | 62 | 0 | 0.07 | 1081 | 13.9 | 57.2 | ○ | | | | |

TABLE 12-continued

| Steel sheet number | Steel type | Heat treatment number | Microstructure: Area percentage (%) α | Hard secondary phase | Other micro-structure | Number density of θ of 0.3 μm or more (number per square micrometer) | Mechanical properties: TS (MPa) | EL (%) | λ (%) | Evaluation | Variation in mechanical properties: ΔTS (MPa) | ΔEL (%) | Δλ (%) | Evaluation |
|---|---|---|---|---|---|---|---|---|---|---|---|---|---|---|
| 11 | 1F | 11 | 39 | 61 | 0 | 0.09 | 1057 | 14.5 | 51.6 | ○ | 21 | 1.2 | 1.4 | ○ |
| 12 | | 12 | 36 | 64 | 0 | 0.09 | 1078 | 13.7 | 50.2 | ○ | | | | |

(Underlined data: out of the scope of the present invention,
—: unevaluated,
α: ferrite
Other microstructures: retained austenite and martensite,
θ: cementite)

TABLE 13

(continued from Table 12)

| Steel sheet number | Steel type | Heat treatment number | Microstructure: Area percentage (%) α | Hard secondary phase | Other micro-structure | Number density of θ of 0.3 μm or more (number per square micrometer) | Mechanical properties: TS (MPa) | EL (%) | λ (%) | Evaluation | Variation in mechanical properties: ΔTS (MPa) | ΔEL (%) | Δλ (%) | Evaluation |
|---|---|---|---|---|---|---|---|---|---|---|---|---|---|---|
| 13 | 1G | 13 | 36 | 64 | 0 | 0.22 | 1091 | 9.2 | 30.5 | x | — | — | — | — |
| 14 | | 14 | 39 | 61 | 0 | 0.06 | 1053 | 14.5 | 60.0 | ○ | — | — | — | — |
| 15 | | 15 | 41 | 59 | 0 | 0.06 | 1040 | 14.9 | 62.8 | ○ | — | — | — | — |
| 16 | | 16 | 36 | 64 | 0 | 0.05 | 1042 | 14.6 | 66.5 | ○ | — | — | — | — |
| 17 | | 17 | 25 | 75 | 0 | 0.18 | 962 | 14.0 | 75.2 | x | — | — | — | — |
| 18 | | 18 | 37 | 63 | 0 | 0.08 | 1025 | 14.2 | 66.4 | ○ | — | — | — | — |
| 19 | | 19 | 42 | 58 | 0 | 0.19 | 1053 | 15.1 | 20.4 | x | — | — | — | — |
| 20 | | 20 | 41 | 59 | 0 | 0.21 | 1160 | 8.9 | 29.7 | x | — | — | — | — |
| 21 | | 21 | 40 | 60 | 0 | 0.17 | 1066 | 14.7 | 21.9 | x | — | — | — | — |
| 22 | | 22 | 43 | 57 | 0 | 0.12 | 1047 | 14.2 | 61.5 | ○ | — | — | — | — |
| 23 | | 23 | 38 | 62 | 0 | 0.07 | 1039 | 14.4 | 65.1 | ○ | — | — | — | — |
| 24 | | 24 | 37 | 63 | 0 | 0.00 | 1285 | 9.8 | 66.1 | x | — | — | — | — |
| 25 | | 25 | 38 | 62 | 0 | 0.13 | 1029 | 14.4 | 60.8 | ○ | — | — | — | — |
| 26 | | 26 | 37 | 63 | 0 | 0.07 | 1045 | 14.2 | 66.1 | ○ | — | — | — | — |
| 27 | | 27 | 42 | 58 | 0 | 0.11 | 1053 | 14.6 | 61.2 | ○ | — | — | — | — |
| 28 | | 28 | 36 | 64 | 0 | 0.09 | 1032 | 14.9 | 61.7 | ○ | — | — | — | — |
| 29 | | 29 | 49 | 51 | 0 | 0.08 | 1028 | 14.3 | 64.4 | ○ | — | — | — | — |
| 30 | | 30 | 18 | 82 | 0 | 0.10 | 1205 | 10.7 | 29.4 | x | — | — | — | — |
| 31 | | 31 | 39 | 61 | 0 | 0.12 | 1273 | 8.9 | 35.5 | x | — | — | — | — |
| 32 | | 32 | 43 | 57 | 0 | 0.07 | 1147 | 13.2 | 43.5 | ○ | — | — | — | — |
| 33 | | 33 | 42 | 58 | 0 | 0.12 | 912 | 17.2 | 55.5 | x | — | — | — | — |
| 34 | | 34 | 43 | 57 | 0 | 0.09 | 1047 | 14.2 | 66.7 | ○ | — | — | — | — |
| 35 | | 35 | 37 | 63 | 0 | 0.13 | 1035 | 14.2 | 62.8 | ○ | — | — | — | — |
| 36 | | 36 | 21 | 79 | 0 | 0.08 | 1078 | 13.5 | 58.4 | ○ | 35 | 0.6 | 3.2 | ○ |
| 37 | | 37 | 27 | 73 | 0 | 0.08 | 1070 | 14.1 | 56.8 | ○ | | | | |
| 38 | | 38 | 35 | 65 | 0 | 0.08 | 1062 | 13.8 | 57.5 | ○ | | | | |
| 39 | | 39 | 39 | 61 | 0 | 0.08 | 1055 | 13.9 | 55.2 | ○ | | | | |
| 40 | | 40 | 43 | 57 | 0 | 0.08 | 1043 | 14.0 | 57.0 | ○ | | | | |
| 41 | | 41 | 22 | 78 | 0 | 0.02 | 1214 | 13.4 | 69.7 | ○ | 132 | 3.3 | 29.2 | x |
| 42 | | 42 | 26 | 74 | 0 | 0.02 | 1185 | 14.1 | 61.1 | ○ | | | | |
| 43 | | 43 | 33 | 67 | 0 | 0.02 | 1102 | 14.8 | 53.7 | ○ | | | | |
| 44 | | 44 | 37 | 63 | 0 | 0.02 | 1057 | 15.3 | 48.1 | ○ | | | | |
| 45 | | 45 | 44 | 56 | 0 | 0.02 | 982 | 16.7 | 40.5 | ○ | | | | |

(Underlined data: out of the scope of the present invention,
—: unevaluated,
α: ferrite
Other microstructures: retained austenite and martensite,
θ: cementite)

TABLE 14

(continued from Table 13)

| Steel sheet number | Steel type | Heat treatment number | Microstructure: Area percentage (%) α | Hard secondary phase | Other micro-structure | Number density of θ of 0.3 μm or more (number per square micrometer) | Mechanical properties: TS (MPa) | EL (%) | λ (%) | Eval-uation | Variation in mechanical properties: ΔTS (MPa) | ΔEL (%) | Δλ (%) | Eval-uation |
|---|---|---|---|---|---|---|---|---|---|---|---|---|---|---|
| 46 | 1H | 46 | 37 | 63 | 0 | 0.17 | 1307 | 9.1 | 20.9 | x | 255 | 3.0 | 2.6 | x |
| 47 | | 47 | 42 | 58 | 0 | 0.18 | 1052 | 12.1 | 23.5 | x | | | | |
| 48 | 1I | 48 | 36 | 64 | 0 | 0.11 | 1107 | 14.0 | 47.2 | ○ | 37 | 0.3 | 2.3 | ○ |
| 49 | | 49 | 35 | 65 | 0 | 0.10 | 1070 | 13.7 | 49.5 | ○ | | | | |
| 50 | 1J | 50 | 38 | 62 | 0 | 0.11 | 1016 | 14.4 | 41.2 | ○ | 9 | 0.0 | 3.9 | ○ |
| 51 | | 51 | 38 | 62 | 0 | 0.12 | 1025 | 14.4 | 45.1 | ○ | | | | |
| 52 | 1K | 52 | 43 | 57 | 0 | 0.08 | 884 | 15.3 | 47.0 | x | — | — | — | — |
| 53 | 1L | 53 | 39 | 61 | 0 | 0.07 | 1042 | 14.5 | 52.1 | ○ | 53 | 0.6 | 2.9 | ○ |
| 54 | | 54 | 40 | 60 | 0 | 0.08 | 1095 | 13.9 | 49.2 | ○ | | | | |
| 55 | 1M | 55 | 40 | 60 | 0 | 0.10 | 1036 | 14.7 | 43.9 | ○ | 15 | 0.3 | 0.0 | ○ |
| 56 | | 56 | 39 | 61 | 0 | 0.09 | 1051 | 14.4 | 43.9 | ○ | | | | |
| 57 | 1N | 57 | 39 | 61 | 0 | 0.08 | 1163 | 14.5 | 61.4 | ○ | 65 | 0.7 | 3.2 | ○ |
| 58 | | 58 | 41 | 59 | 0 | 0.10 | 1098 | 13.8 | 58.2 | ○ | | | | |
| 59 | 1O | 59 | 36 | 64 | 0 | 0.07 | 1091 | 14.0 | 64.1 | ○ | 22 | 0.2 | 3.8 | ○ |
| 60 | | 60 | 39 | 61 | 0 | 0.08 | 1069 | 14.2 | 60.3 | ○ | | | | |
| 61 | 1P | 61 | 42 | 58 | 0 | 0.11 | 1082 | 15.1 | 49.2 | ○ | 27 | 0.4 | 3.3 | ○ |
| 62 | | 62 | 40 | 60 | 0 | 0.10 | 1055 | 15.5 | 45.9 | ○ | | | | |
| 63 | 1Q | 63 | 38 | 62 | 0 | 0.08 | 1016 | 14.4 | 57.4 | ○ | 43 | 0.7 | 5.1 | ○ |
| 64 | | 64 | 39 | 61 | 0 | 0.09 | 1059 | 13.7 | 52.3 | ○ | | | | |
| 65 | 1R | 65 | 16 | 84 | 0 | 0.17 | 1357 | 10.6 | 26.8 | x | — | — | — | — |
| 66 | 1S | 66 | 41 | 59 | 0 | 0.08 | 1015 | 14.9 | 49.4 | ○ | — | — | — | — |
| 67 | 1T | 67 | 40 | 60 | 0 | 0.07 | 1066 | 14.7 | 49.1 | ○ | — | — | — | — |
| 68 | 1U | 68 | 40 | 60 | 0 | 0.09 | 1051 | 14.7 | 55.6 | ○ | — | — | — | — |
| 69 | 1V | 69 | 39 | 61 | 0 | 0.07 | 1011 | 14.5 | 60.1 | ○ | — | — | — | — |
| 70 | 1W | 70 | 39 | 61 | 0 | 0.07 | 1288 | 11.8 | 38.5 | x | — | — | — | — |
| 71 | 1X | 71 | 38 | 62 | 0 | 0.11 | 1016 | 14.4 | 48.2 | ○ | — | — | — | — |
| 72 | 1Y | 72 | 41 | 59 | 0 | 0.06 | 986 | 14.9 | 54.8 | ○ | — | — | — | — |
| 73 | 1Z | 73 | 38 | 62 | 0 | 0.12 | 1078 | 14.4 | 51.5 | ○ | — | — | — | — |
| 74 | 2A | 74 | 42 | 58 | 0 | 0.11 | 1024 | 15.1 | 51.2 | ○ | — | — | — | — |
| 75 | 2B | 75 | 38 | 62 | 0 | 0.12 | 1078 | 14.4 | 42.5 | ○ | — | — | — | — |
| 76 | 2C | 76 | 36 | 64 | 0 | 0.06 | 1043 | 14.0 | 56.8 | ○ | — | — | — | — |
| 77 | 2D | 77 | 92 | 8 | 0 | 0.07 | 708 | 24.4 | 87.1 | x | — | — | — | — |
| 78 | 2E | 78 | 41 | 59 | 0 | 0.11 | 1000 | 14.9 | 53.2 | ○ | — | — | — | — |
| 79 | 2F | 79 | 42 | 58 | 0 | 0.07 | 1067 | 15.1 | 52.1 | ○ | — | — | — | — |
| 80 | 2G | 80 | 37 | 63 | 0 | 0.07 | 1069 | 14.2 | 51.1 | ○ | — | — | — | — |

(Underlined data: out of the scope of the present invention,
—: unevaluated,
α: ferrite
Other microstructures: retained austenite and martensite,
θ: cementite)

While the present invention has been particularly described with reference to preferred embodiments thereof, it will be understood by those skilled in the art that various changes and modifications may be made without departing from the spirit and scope of the invention.

The present application is based on Japanese Patent Application No. 2011-274268 filed on Dec. 15, 2011 and Japanese Patent Application No. 2011-274269 filed on Dec. 15, 2011, the entire contents of which are incorporated herein by reference.

INDUSTRIAL APPLICABILITY

High-strength steel sheets according to the embodiments of the present invention have excellent workability and are suitable typically for automobile parts.

The invention claimed is:

1. A cold-rolled steel sheet, comprising:

C in a content of 0.05% to 0.30%;

Si in a content of greater than 0% to 3.0%;

Mn in a content of 0.1% to 5.0%;

P in a content of greater than 0% to 0.1%;

S in a content of greater than 0% to 0.02%;

Al in a content of 0.01% to 1.0%; and

N in a content of greater than 0% to 0.01%, in mass percent in a chemical composition, wherein:

the cold-rolled steel sheet further comprises iron and inevitable impurities in the chemical composition;

the cold-rolled steel sheet comprises ferrite as a soft primary phase in an area percentage of 20% to 50% in a microstructure;

the cold-rolled steel sheet further comprises at least one of tempered martensite and tempered bainite as a hard secondary phase in the microstructure; and the cold-rolled steel sheet meets one of conditions (a) and (b) as follows:

(a) cementite particles having an equivalent circle diameter of 0.05 μm to less than 0.3 μm are dispersed in grains of the ferrite in a number density of greater than 0.15 to 0.50 per square micrometer of the ferrite; and (b) cementite particles having an equivalent circle diameter of 0.3 μm or more are dispersed in grains of the ferrite in a number density of 0.05 to 0.15 per square micrometer of the ferrite.

2. The steel sheet according to claim 1, further comprising:

Cr in a content of 0.01% to 1.0%, in the chemical composition.

3. The steel sheet according to claim 1, further comprising at least one element selected from the group consisting of:

Mo in a content of 0.01% to 1.0%;

Cu in a content of 0.05% to 1.0%; and

Ni in a content of 0.05% to 1.0%, in the chemical composition.

4. The steel sheet according to claim 1, further comprising at least one element selected from the group consisting of:

Ca in a content of 0.0001% to 0.01%;

Mg in a content of 0.0001% to 0.01%;

Li in a content of 0.0001% to 0.01%; and a rare-earth element (REM) or REMs in a content of 0.0001% to 0.01%, in the chemical composition.

5. The steel sheet according to claim 1, wherein the cold-rolled steel sheet meets condition (a):

(a) cementite particles having an equivalent circle diameter of 0.05 μm to less than 0.3 μm are dispersed in grains of the ferrite in a number density of greater than 0.15 to 0.50 per square micrometer of the ferrite.

6. The steel sheet according to claim 1, wherein the cold-rolled steel sheet meets condition (b):

(b) cementite particles having an equivalent circle diameter of 0.3 μm or more are dispersed in grains of the ferrite in a number density of 0.05 to 0.15 per square micrometer of the ferrite.

7. The steel sheet according to claim 1, wherein the cold-rolled steel sheet further comprises tempered martensite as a hard secondary phase in the microstructure.

8. The steel sheet according to claim 1, wherein the cold-rolled steel sheet further comprises tempered bainite as a hard secondary phase in the microstructure.

9. The steel sheet according to claim 1, wherein the cold-rolled steel sheet further comprises tempered martensite and tempered bainite as a hard secondary phase in the microstructure.

10. The cold-rolled steel sheet according to claim 1, comprising:

C in a content of 0.10% to 0.25%;

Si in a content of greater than 0.5% to 2.5%;

Mn in a content of 0.5% to 2.5%;

P in a content of greater than 0% to 0.05%;

S in a content of greater than 0% to 0.015%;

Al in a content of 0.01% to 1.0%; and

N in a content of greater than 0% to 0.01%, in mass percent in the chemical composition.

11. The cold-rolled steel sheet according to claim 1, comprising:

C in a content of 0.14% to 0.20%;

Si in a content of greater than 1.0% to 2.2%;

Mn in a content of 1.2% to 2.2%;

P in a content of greater than 0% to 0.03%;

S in a content of greater than 0% to 0.010%;

Al in a content of 0.01% to 1.0%; and

N in a content of greater than 0% to 0.01%, in mass percent in the chemical composition.

12. A method for manufacturing a cold-rolled steel sheet according to claim 1, the method comprising:

preparing a steel having the chemical composition;

hot-rolling and subsequently cold-rolling the steel to obtain a steel sheet as a work;

annealing the work after the cold rolling; and tempering the work after the annealing, wherein:

the hot rolling has a finish rolling end temperature of $Ar_3$ point or higher and a coiling temperature of 450° C. to 600° C., the cold rolling has a cold rolling reduction of 20% to 50%, the annealing comprises:

heating the work from room temperature up to 600° C. at a first heating rate of greater than 5.0° C/s to 10.0° C/s and further heating the work from 600° C. up to an annealing temperature at a second heating rate of half the first heating rate or less; holding the work at the annealing temperature of Ac1 to lower than (Ac1+Ac3)/2 for an annealing holding time of 3600 seconds or shorter; slowly cooling the work from the annealing temperature down to a first cooling end temperature of 730° C. to 500° C. at a first cooling rate of 1° C./s to less than 50° C./s; and thereafter rapidly cooling the work down to a second cooling end temperature of Ms point or lower at a second cooling rate of 50° C./s or more;

or the annealing comprises:

heating the work from room temperature up to 600° C. at a first heating rate of 0.5° C./s to 5.0° C/s and further heating the work from 600° C. up to an annealing temperature at a second heating rate half the first heating rate or less; holding the work at the annealing temperature of (Ac1+Ac3)/2 to Ac3 for an annealing holding time of 3600 seconds or shorter; slowly cooling the work from the annealing temperature down to a first cooling end temperature of 730° C. to 500° C. at a first cooling rate of 1° C/s to less than 50° C./s; and thereafter rapidly cooling the work down to a second cooling end temperature of Ms point or lower at a second cooling rate of 50° C./s or more, and the tempering has a tempering temperature of 300° C. to 500° C. and a tempering holding time in a temperature range of 300° C. to the tempering temperature for 60 to 1200 seconds.

* * * * *